United States Patent [19]

Hannaford et al.

[11] 4,235,050

[45] Nov. 25, 1980

[54] SKATE SHARPENING APPARATUS

[75] Inventors: James H. Hannaford, Calgary; Warren Myrfield, Aldergrove; David H. Weiler; Frederick N. Trofimenkoff, both of Calgary; Joseph A. Consay; Donald M. Dobie, both of Calgary, all of Canada

[73] Assignee: Universal Skate Sharpener Ltd., Calgary, Canada

[21] Appl. No.: 943,525

[22] Filed: Sep. 18, 1978

[30] Foreign Application Priority Data

Jul. 13, 1978 [CA] Canada ..... 307281

[51] Int. Cl.[3] ..... B24B 19/00

[52] U.S. Cl. ..... 51/34 D; 51/165.92; 51/228

[58] Field of Search ..... 51/34 E, 34 D, 228, 51/165.77, 165.92

[56] References Cited

U.S. PATENT DOCUMENTS

| | | | |
|---|---|---|---|
| 3,415,017 | 12/1968 | Murray | 51/136 |
| 3,735,533 | 5/1973 | Salberg | 51/228 |
| 3,827,185 | 8/1974 | Smith | 51/228 |
| 3,948,001 | 4/1976 | Miyazawa | 51/165.92 |

*Primary Examiner*—Harold D. Whitehead

*Attorney, Agent, or Firm*—Larson, Taylor and Hinds

[57] ABSTRACT

Grinding apparatus is disclosed with the preferred embodiment being an automatic ice skate sharpening machine. The workpiece is secured to the frame, and a grinding wheel, mounted on a longitudinally moveable carriage, is biased against the workpiece for relative grinding movement. Sensing means are provided for detecting the grinding resistance of the workpiece on the grinding wheel, and control means responsive to the sensing means are provided for regulating the bias of the grinding wheel against the workpiece, in order to avoid chattering.

16 Claims, 41 Drawing Figures

FIG. 23J LEGEND

| | | |
|---|---|---|
| FIG.23A | FIG.23B | FIG.23C |
| FIG.23D | FIG.23E | FIG.23F |
| FIG.23G | FIG.23H | FIG.23I |
| FIG.23J | | |

SKATE SHARPENING APPARATUS

DESCRIPTION OF THE PRIOR ART

Numerous types of ice skate sharpening means have heretofore been proposed. Such means generally fall into two classes:

(a) Floor-mounted machines in which the skate is secured in a jig or clamp, and is brough into engagement with a rotating powered grinding wheel, rotating in a plane either parallel to, or at right angles to the skate blade. The opertion is either totally manual, or may be automated to some extent, but in most cases some degree of skill is required from the operator;

(b) Alternatively, various hand-sharpening tools have been proposed, which are applied in reciprocating movement against the skate blade edge; an abrasive pressure is exerted against the skate edge in order for the abrasive action to be effective, and repeated "passes" over the blade are normally required. When the cutting component becomes worn, however, the contour of the cut becomes uncertain, as does the depth of cut.

The recent development of ice skating, both hockey playing and pleasure skating, has indicated the need for a totally automated, rapid and precise skate grinding apparatus which may be installed in floor-mounted position at ice rinks, and this invention relates to a new and useful improvement in this area.

BRIEF SUMMARY OF THE INVENTION

The illustrative floor-mounted ice skate sharpener comprises: a console which houses a clamping means for securing a pair of ice skates in rigid upright heel-to-heel relationship; grinding means whereby a powered grinding wheel is brought into longitudinal engagement with the edge of the blade, following the contour of the edge over its total length in accurate controlled engagement with the edge, the biasing of the grinding wheel against the blade edge being automatically controlled, responsive to the resistance offered by the blade edge to the rotation of the grinding wheel and thereby avoiding the condition of "chattering" of the wheel against the blade which results in nicks, gouges and other non-curvilinear contours to the blade edge; programming means whereby the grinding wheel is caused to take a controlled number of passes over the skate blade; access means to the console whereby the console is opened only after a customer places indicated coinage in a coin receiver included in the console, the console remaining accessible only during the remainder of the cycle and, after completion of the sharpening operation and removal of the skates, then closing and remaining secure until reactivated by subsequent coinage insertion; and grinding wheel dressing means whereby the grinding wheel is periodically recontoured automatically and in programmed fashion, in order to achieve a continuously accurate hollow grind on the skate blade edge.

It will be appreciated, therefore, that an object of the present invention is to provide a sharpener apparatus of the general character described herein which is not subject to the disadvantages of the prior art.

Specifically, it is an object of the present invention to provide an automated sharpener particularly applicable for sharpening ice skates to accurate and precise contour, without the risk of gouging and nicking occasioned by chattering of the wheel against the blade produced from the unequal speeds resulting where the wheel is brought abruptly into engagement with the blade and then attempts to follow its contour while travelling in only one direction along the blade edge.

Another object of this invention is to provide a sharpener which is relatively compact and does not require any special skills to operate.

The disclosed embodiment of this invention provides:

(a) an ice skate blade sharpener which achieves a hollow-ground blade edge, and includes a grinding wheel having a cutting edge transverse contour which corresponds to the transverse contour of the blade edge;

(b) a sharpener device which prevents abrasion damage to the blade edge caused by chattering of the grinding wheel against the blade edge arising from irregular rotational speed of the grinding wheel.

According to one aspect of this invention, a skate blade sharpener is provided comprising a floor-mounted console including a frame, housing, and a moveable access cover providing controlled access to an interior skate grinding space; clamping means for fixedly securing a pair of skates in heel-to-heel in-line abutting relationship, said clamping means being self-equalizing in order to accomodate a pair of skate blades the members of which may be either of varying thickness or bent or otherwise deformed but still functional; a longitudinally-extending grinding wheel carriage assembly including a grinding wheel sub-assembly pivoted therefore, and recriprocating drive means for movement of the carriage assembly relative to the pair of skate blades; a generally thin flat grinding wheel having a contoured convex face to produce a concave skate grind; rotating drive means for providing reversible uniform rotational drive to the grindstone; means for dressing the grinding wheel after each grinding operation in order to restore the transverse contour of the stone, thereby to assure a hollow grind on the skate blade; controlled bias means whereby the grinding wheel is brought into engagement with the skate blade so as to avoid "chattering" of the grinding wheel against the blade with resulting undesirable gouges; programming means for directing the sequence of clamping, grind, wheel dressing, internal dust collection and finally, opening of the console cover and releasing of the clamping means permitting removal of the skates for use.

Desirably, the apparatus is also provided with indicator lights designating conditions of out-of-order and undersized grinding wheel.

Optionally, the apparatus may be provided with a coin-receiving mechanism included in the circuitry of the apparatus which requires the feeding of coinage of previously determined denomination. Suitable coin-receiving devices are well-known in the art and need not be further desribed in this specification.

The apparatus is intended to be operated automatically, after the operator has taken certain initial steps of inserting coinage and placing the skates in position within the console.

The above and other objects, features and advantages of this invention will be apparent from the following description of the preferred embodiments when considered in connection with the accompanying drawings.

BRIEF DESCRIPTION OF THE DRAWINGS

FIG. 23 is a schematic of the electrical circuits of the skate blade sharpener;

FIGS. 23A–23K, shows schematically the electrical circuits of the skate blade sharpener;

DETAILED DESCRIPTION OF THE EMBODIMENT

Figure 1:
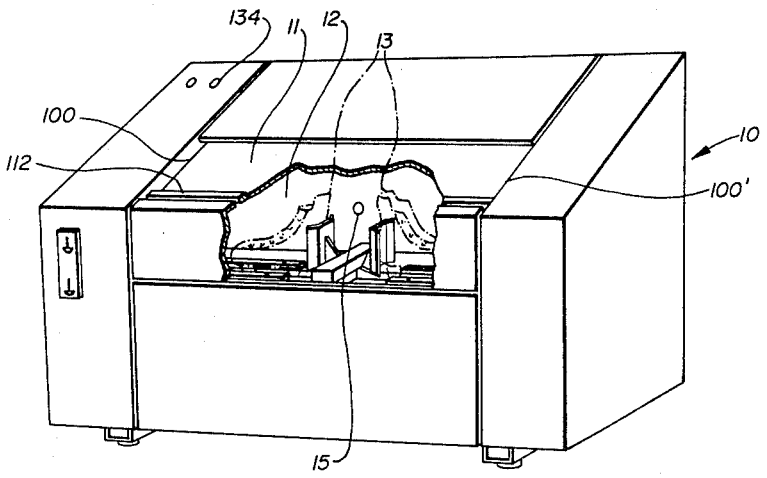
FIG. 1 is a perspective view of the console of the device, with a portion of the cover removed, depicting a pair of hockey skates secured in position for sharpening the skate blades.

Referring now in detail to the drawings, the reference numeral 10 denotes generally the sharpener device which includes, in the present embodiment, an elongated floor-mounted console 10, supplied with an external electrical power source which will normally be 115 v. A.C. single phase, with a slideable opening cover 11 exposing an interior grinding space 12 in which the skates 13 to be sharpened are placed as depicted in FIG. 1, in heel-to-heel abutting relationship as further depicted in FIG. 2, within clamp means generally indicated at 14 in FIG. 3. The operating cycle is activated by means of the start button 15, located inside the grinding space 12, which causes the sliding cover 11 to close and the skate blades to be secured within the clamping means 14. The apparatus then proceeds into the grinding cycle, on completion of which the sliding cover is powered to its open position, the clamping means are released and the skates may be removed from the apparatus for use. After a further interval of several seconds duration, the sliding cover 11 closes, and the apparatus shuts down in locked condition to complete the cycle.

The apparatus may be functionally divided into the clamping assembly, depicted generally at 14, the grinding assembly generally designated at 16, the grinding wheel carriage assembly 17, the grinding wheel dressing assembly 18, the vacuum system 19, the hydraulic power system 20, all of the foregoing as indicated in FIGS. 1, 2, 3, and 8 and the electrical controls and logic, 300.

CLAMPING ASSEMBLY

Figure 2:
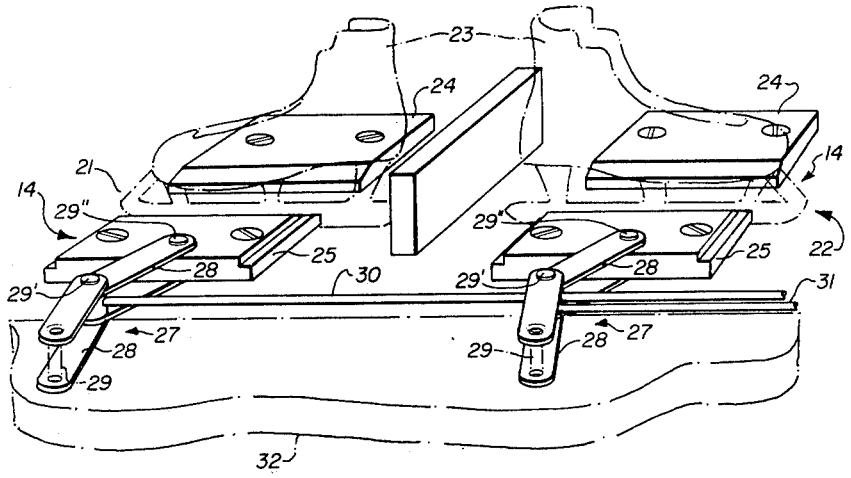
FIG. 2 is an enlarged perspective view of the clamping mechanism, depicting a pair of skates in phantom outline, illustrating the manner in which the skate blades are secured in position for the sharpening operation.
Figure 3:
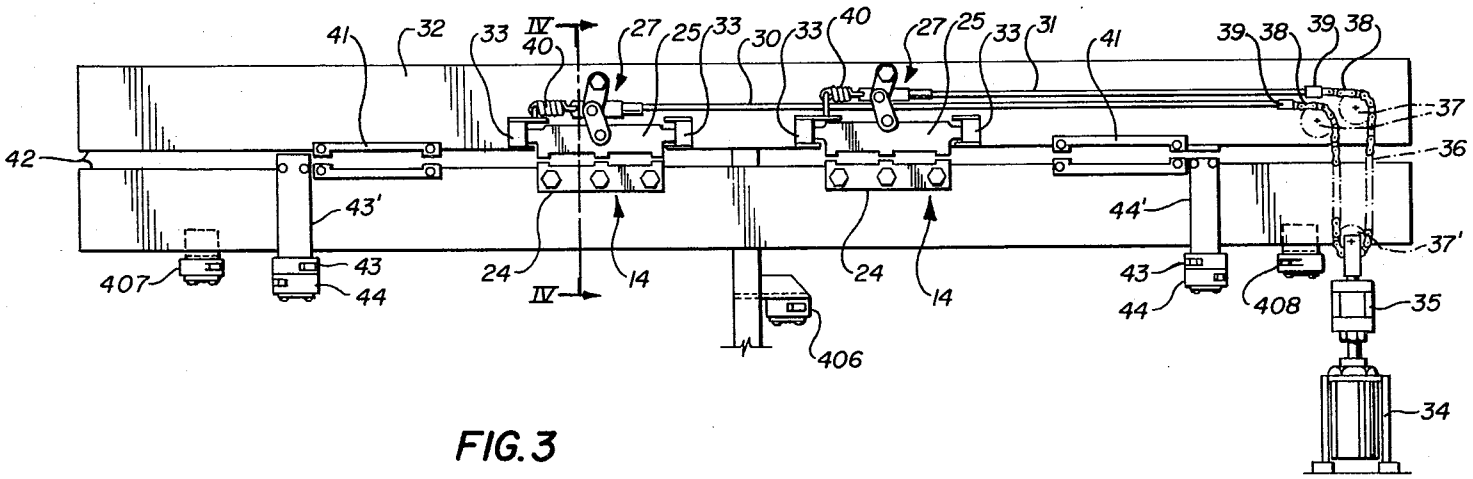
FIG. 3 is a plan view of the clamping mechanism of FIG. 2, depicting the structure of the clamps and associated linkage.
Figure 4:
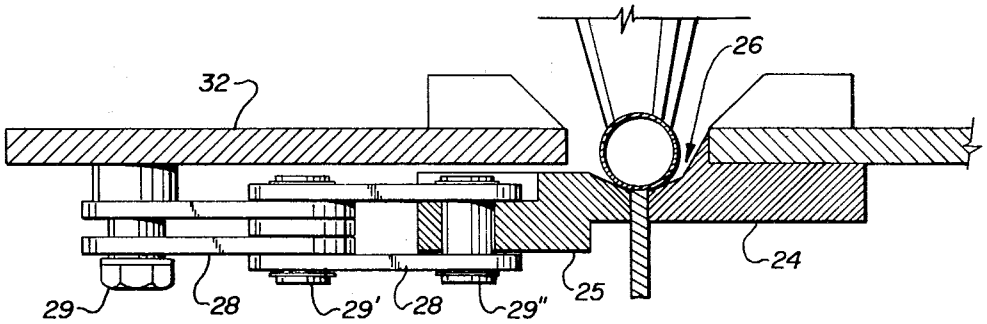
FIG. 4 is an enlarged section taken at 4—4 of FIG. 3, further depicting the structure of the clamping mechanism, with a skate clamped in position for sharpening.

Proceeding now to a detailed description of the clamping assembly 14, reference is had to FIG. 2 which depicts a pair of clamps at 21 and 22, for each of the pair of skates 23. The clamps each comprise one stationary clamp member 24, and one laterally moveable clamp member 25, interfacing with the stationary clamp member to define a skate blade slot 25 as depicted in FIG. 4. Lateral movement of the moveable clamp member 25 is powered by a toggle assembly indicated generally at 27 in FIGS. 2 and 3, which includes toggle links 28, toggle pins 29, 29' and 29'', and toggle actuating rods 30 and 31 secured to each of the toggle assemblies 27. Toggle pin 29 is fixedly secured to the deck member 32 which comprises a portion of the console assembly slotted. Guide member 33, keyed into the moveable clamp members 25 to sliding rectilinear movement for clamping action with the registering stationary clamping member 24. A hydraulic cylinder 34, depicted in FIG. 3 and mounted on the console frame, transmits motion to the toggle actuating rods 30 31 through a tension-activated switch 35, roller chain 36, and sprockets 37. Ends of the roller chain are secured as by roller pins 38 to the distal ends 39 of the toggle actuating rods 30 and 31 as depicted in FIG. 3; directional change in the roller chain 36 is achieved over the pair of idler sprockets 36, and the single sprocket 37' secured to the tension switch frame 35 for free rotation thereon, as depicted in FIG. 3. It will thus be appreciated that by means of the roller chain and sprocket assembly just described, equal tension is exerted at all times on each of the pair of moveable clamping members 25, which permits the skate blade sharpener to operate on skate blades of unequal width while maintaining adequate clamping pressure; thus, the clamping of skate blades which have become bent or otherwise irregular through rough use, is facilitated. The tension-actuated switch 35 is positioned in the clamping assembly in order to ensure that the skates are securely clamped before the grinding sequence is started, as will be hereinafter explained.

Return springs 40, FIG. 3, bias the moveable clamp members 25 into their open positions and additionally maintain tension on the toggle actuating rods 30 and 31 and roller chain 36.

Longitudinal positioning of the skates 23 in the skate blade slot 26 is achieved by the hand operation of a pair of toe clamps 41, slideable longitudinally in stationary ways 42, depicted in FIG. 3. Limit switches 43 and 44 are mounted on each of the toe clamps 41, in order to define the range of travel of the grinding wheel carriage assembly 16, as will be hereinafter explained.

GRINDING ASSEMBLY

Figure 8:
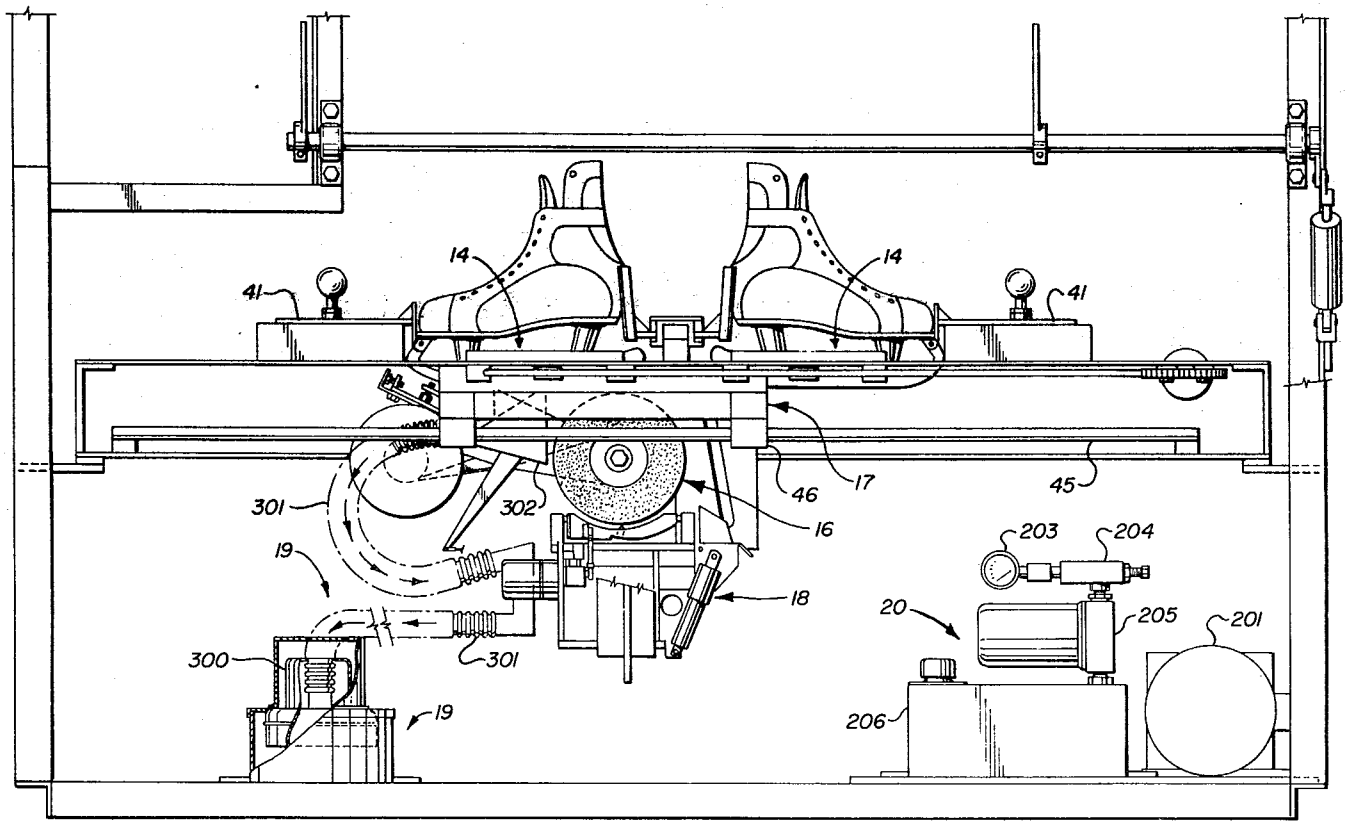
FIG. 8 is a front elevation of the grinding wheel chassis and carriage assembly, as mounted in the console frame, depicting additionally the grinding wheel dressing mechanism, the exhaust system for removing metal particles produced in the grinding action, the hydraulic power system and the cover operating assembly for opening and closing the console cover.
Figure 8A:
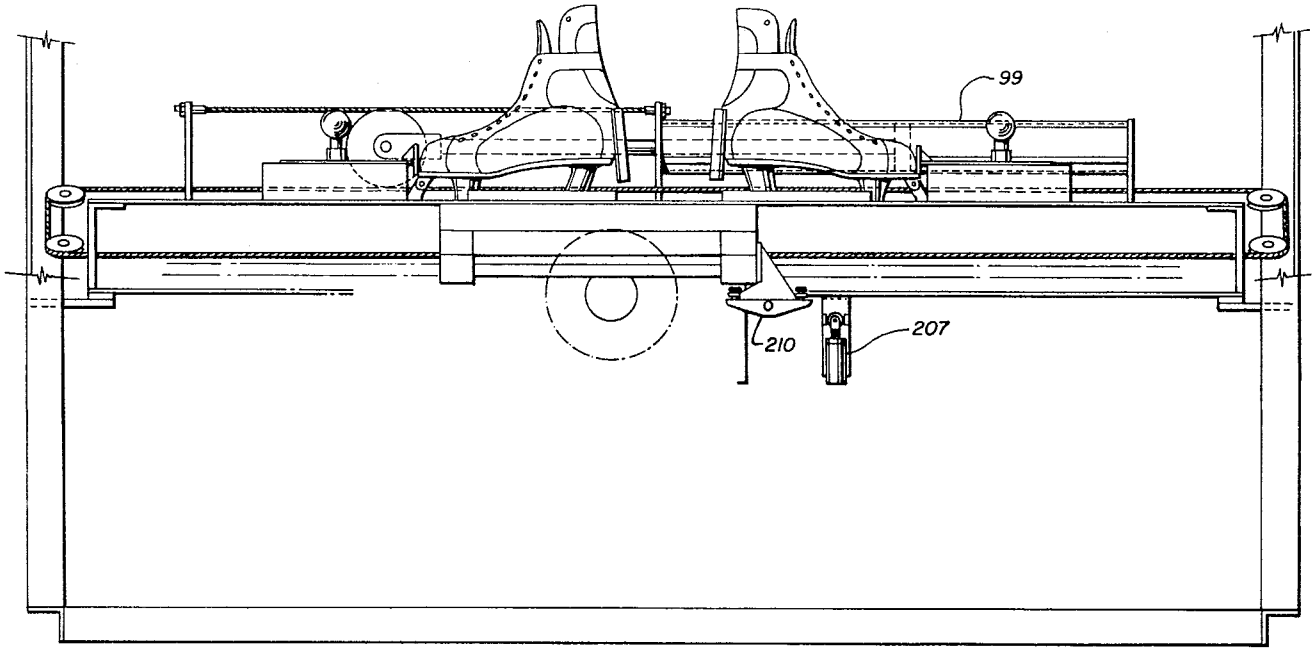
FIG. 8A is the front elevation of the grinding wheel chassis and carriage assembly of FIG. 8, with portions removed, but additionally showing the traversing mechanism of the grinding wheel carriage assembly.
Figure 9:
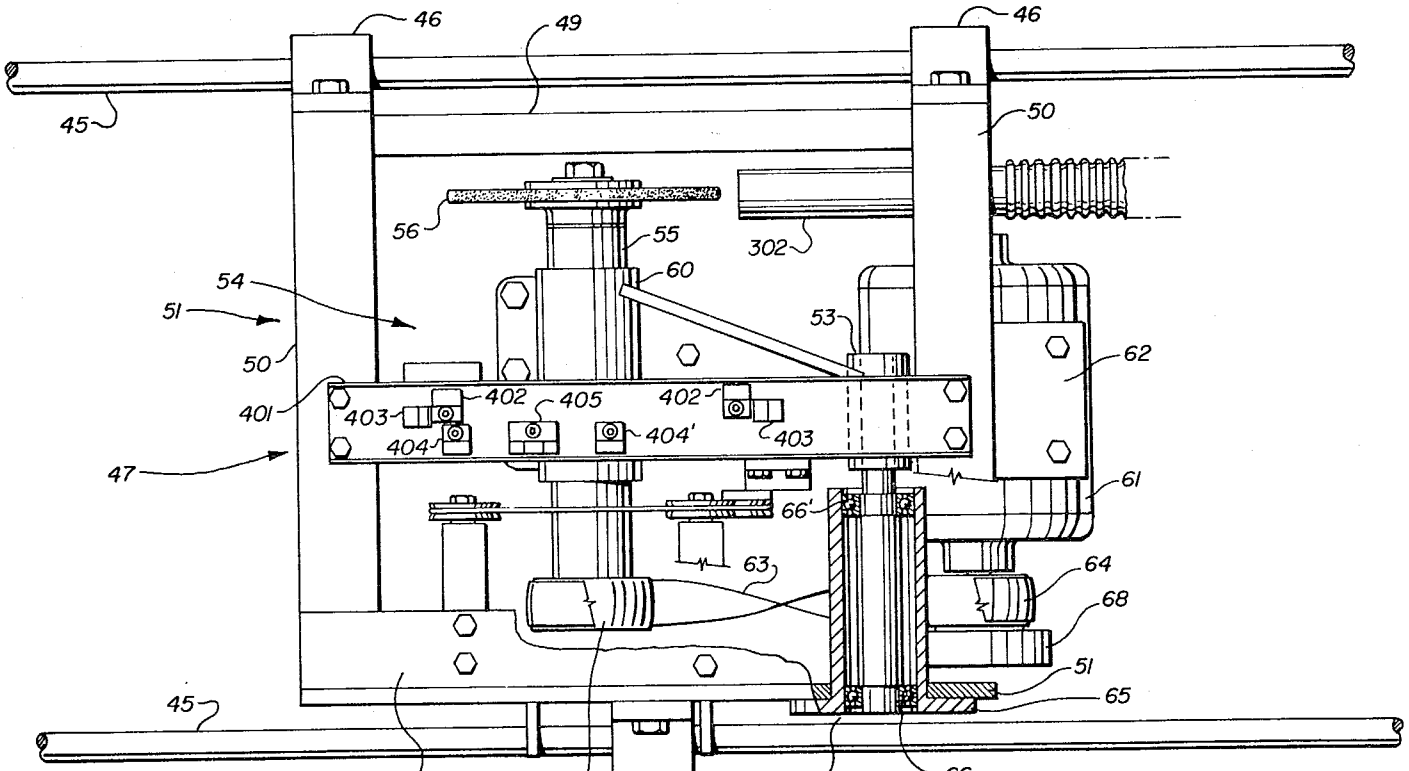
FIG. 9 is an enlarged plan view of the grinding wheel carriage, illustrating the relationship of the rails, carriage, grinding wheel and grinding wheel power unit.
Figure 9A:
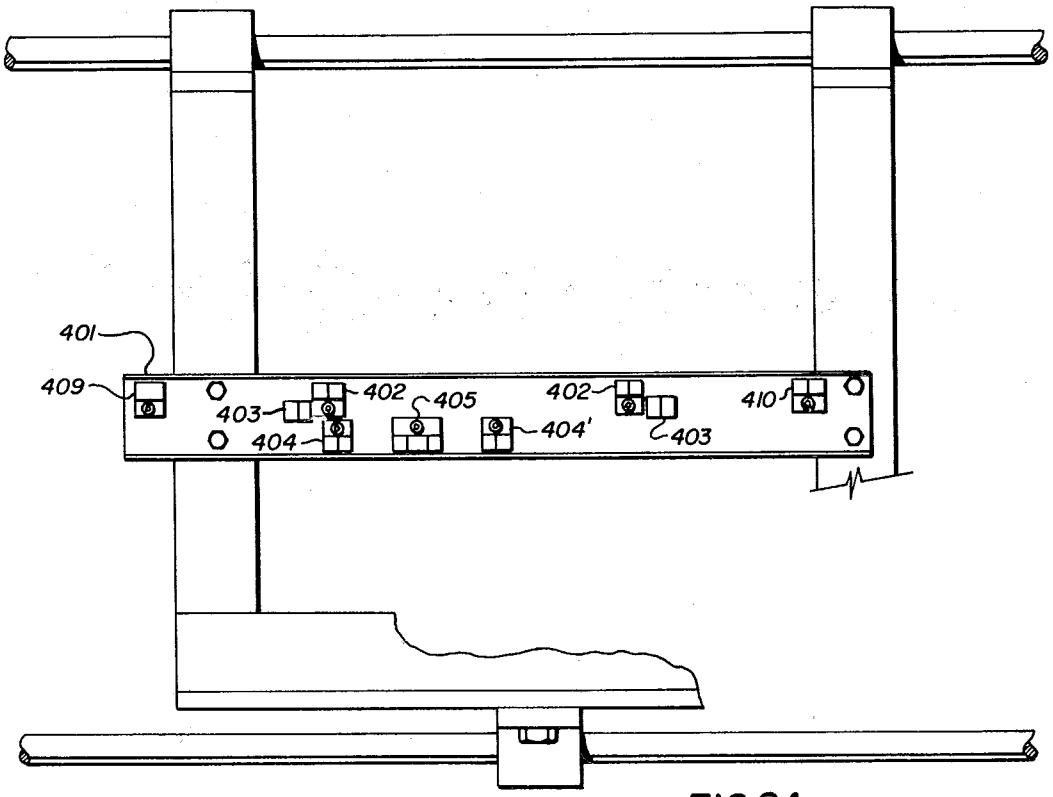
FIG. 9A is a plan view of a portion of the chassis of the grinding wheel carriage assembly depicting the layout of microswitches.
Figure 10:
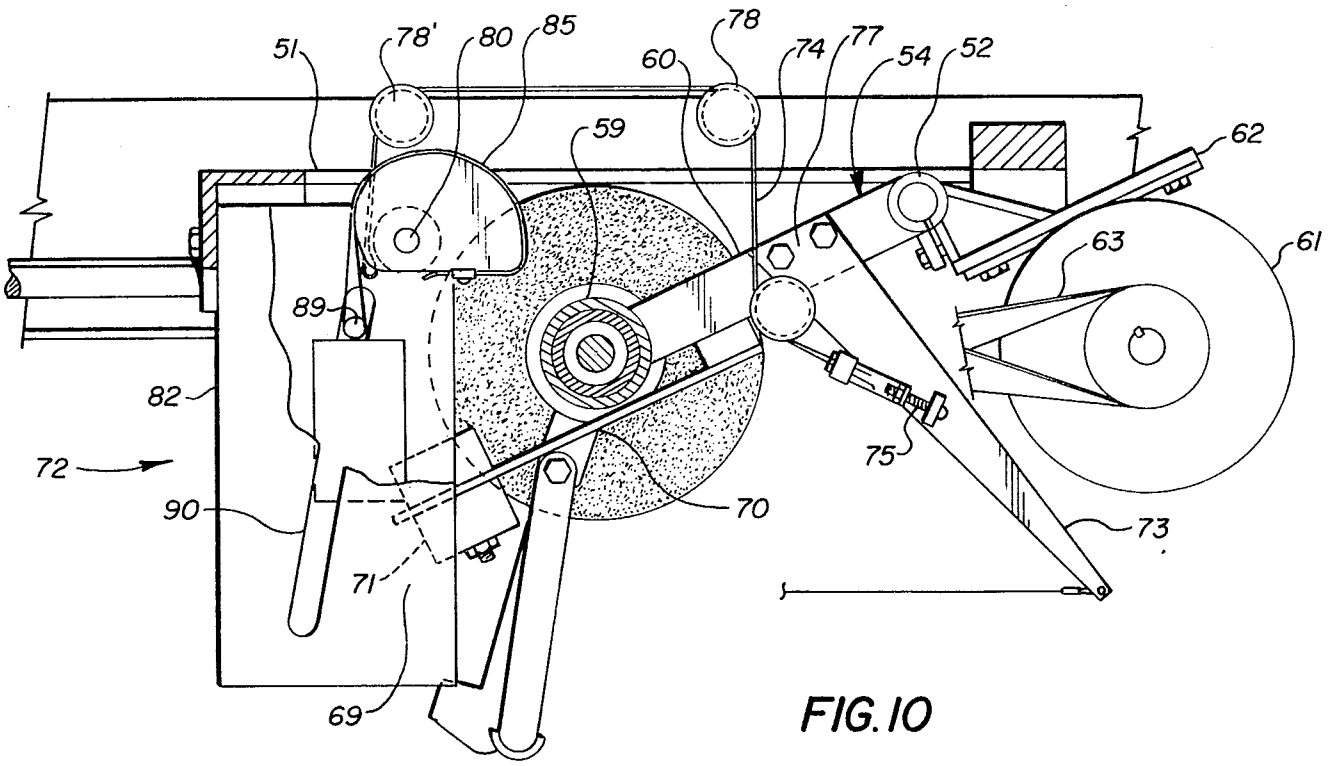
FIG. 10 is a side elevation of the grinding wheel counter-balance mechanism in mid-position.
Figure 11:
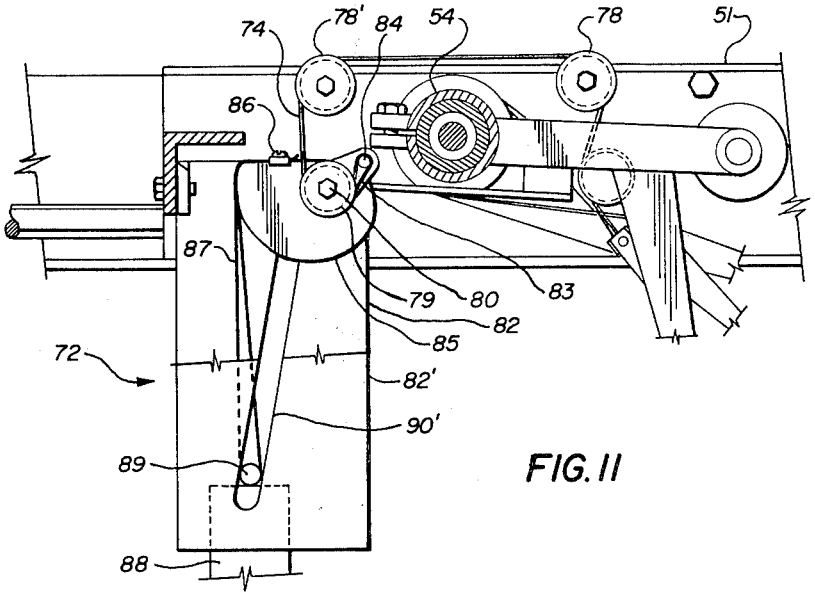
FIG. 11 is the grinding wheel counter-balance mechanism of FIG. 10 depicting the grinding wheel in the raised position.
Figure 12:
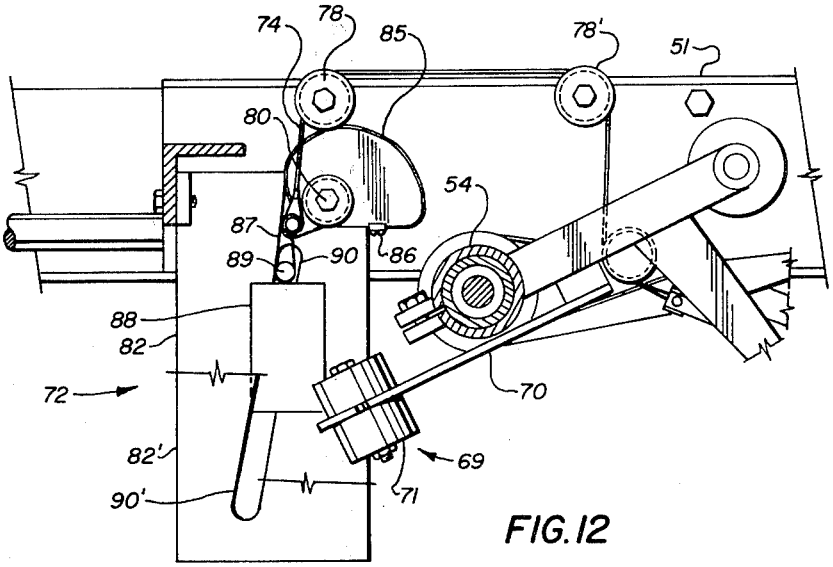
FIG. 12 is the grinding wheel counter-balance mechanism of FIG. 10 depicting the grinding wheel in the lowered position.
Figure 18:
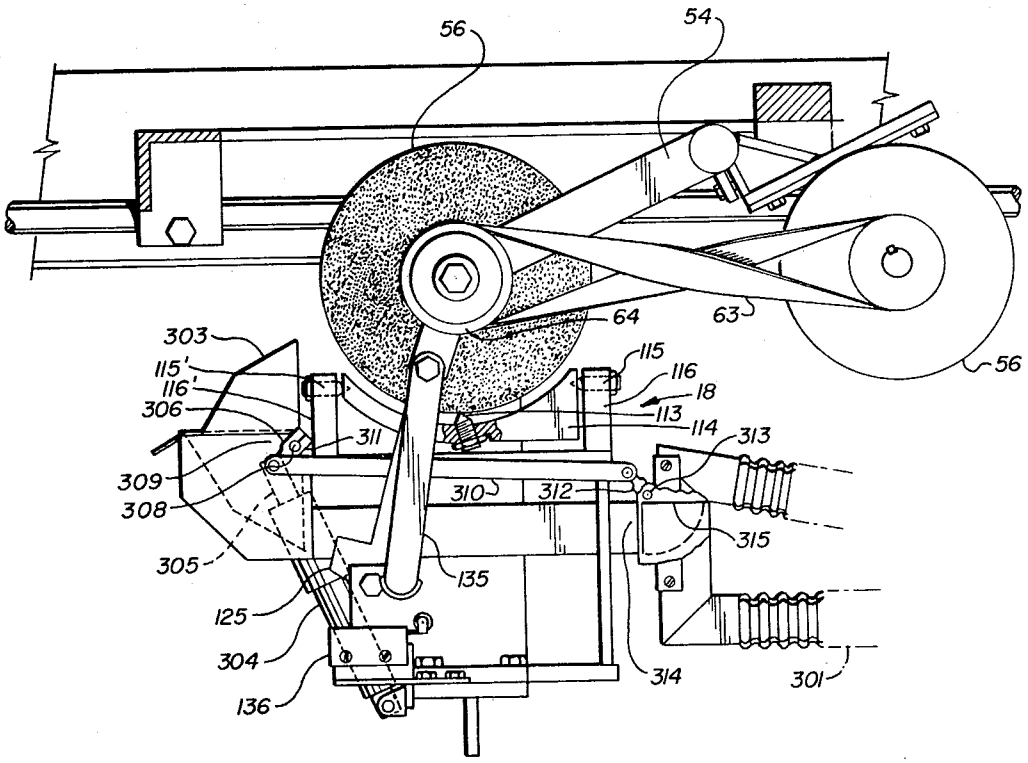
FIG. 18 is a side elevation of the dressing assembly of FIG. 17.

Reference will now be made to FIGS. 8 and 9 in which a pair of rails 45 are rigidly secured in horizontal position within the console, to support in suspended relationship the grinding wheel carriage assembly 17 on sliding bearings 46. A carriage chassis 47, FIG. 9, includes longitudinal frame members 48 and 49 and a pair of cross members 50 rigidly secured thereto, to provide an open box frame 51. Referring now to FIGS. 10 through 12, pivotally suspended below the box frame 51 by means of outboard bearing 52 and grinding unit bearing 53 is a grinding wheel and driving assembly generally designated 54, which includes a spindle 55 carrying an outboard-mounted grinding wheel 56 secured by retaining flange 57 and nut 58, FIG. 6, to an end of spindle 55 rotatable in a single spindle bearing 59, supported by the spindle bearing support member 60, FIG. 10. An electric motor drive comprising a motor 61, motor mounting backet 62 and flat belt 63, powers the grinding wheel sheave 64, FIG. 18. Outboard bearing generally designated 52 including a housing 65 bolted to the carriage box frame 51, and a pair of anti-friction bearings 66 and 66' FIG. 9, support the motor shaft 57 extending horizontally therefrom to engage the grinding unit journal bearing 53; a flywheel 68, mounted on the motor shaft, is positioned adjacent the sheave 64. It will be understood from the foregoing description of the grinding assembly, that the grinding wheel is pivotally suspended below the carriage in order to permit its being raised or lowered relative to the skate clamping assembly, while the entire grinding wheel and drive assembly 54 is moveable horizontally longitudinally relative to the skate clamping assembly, as will be hereinafter described. Opposite rotation of the motor shaft and the grinding wheel spindle is achieved by means of the crossed flat belt 63, as is depicted in FIG. 18, in order to substantially cancel out the reaction on the grinding wheel and drive assembly 54 of the two rotating masses of the motor/flywheel and the grinding wheel; proportioning of the flywheel 68 ensures that the two rotating moments of inertia are substantially equal.

Weight balancing of the grinding wheel and drive assembly is achieved by means of an adjustable cantilever balancing means 69, FIGS. 10 and 12, comprising a rigid balance arm 70 and adjustable weight 71, which permit the grinding wheel to be adjusted to a condition of normal downward bias, against the upward bias of the hysteresis clutch, which will subsequently be explained.

Additional compensating balancing of the grinding wheel and drive assembly 54 for reasons which will become apparent as this disclosure proceeds, is achieved by a weighted cable and cam construction generally designated 72 in FIGS. 10, 11 and 12, which will now be described. A torque arm 73 is secured in downwardly depending relationship to the spindle support member 60 and substantially at right angles thereto, as illustrated in FIG. 10. Cable 74 is anchored to the torque arm 73 by an adjustable anchor screw 75. The cable 74 passes over a sheave 76, mounted on torque arm 73 adjacent its fixed end 77, and continues over each member of the pair of direction-reversing sheaves 78 and 78', rotatably mounted on the box frame 51 of the grinding wheel carriage assembly 17, taking a partial wrap around a sheave 79 mounted on a cam shaft 80 which in turn is rotatably secured to the carriage frame 51 in the pair of anti-friction bearings 81 and 81' and their respective mounting plates 82 and 82'. The cable 74 is secured to a second torque arm 83 at its distal end 84 keyed to the camshaft 80, as depicted in FIG. 11. It will thus be understood that the cable 74 is in contact with sheave 79 only until it is raised from the surface thereof by rotation (clockwise as viewed in FIG. 12) of the shaft 80, thereby increasing the moment arm of the force exerted by cable 74 on the shaft 80.

A cam 85, FIGS. 10, 11 and 12, is keyed to the camshaft 80, to which is anchored as by screw fastener 86, a cable 87, supporting a counterweight 88 by means of a horizontally extending pin 89. The mounting plates 82 and 82' include slotted apertures 90 and 90', which engage the extensions of the pin 89 as guides, and track the locus of travel of the pin 89 and the counterweight 88 in its rectilinear inclined path.

The profile of the cam 85 is such that the turning moment of the counterweight 88 on the camshaft 80 will cancel the out-of-balance moment of the grinding wheel and drive assembly 54 as it rotates through its arc of travel depicted in FIGS. 10, 11 and 12.

Figure 13:
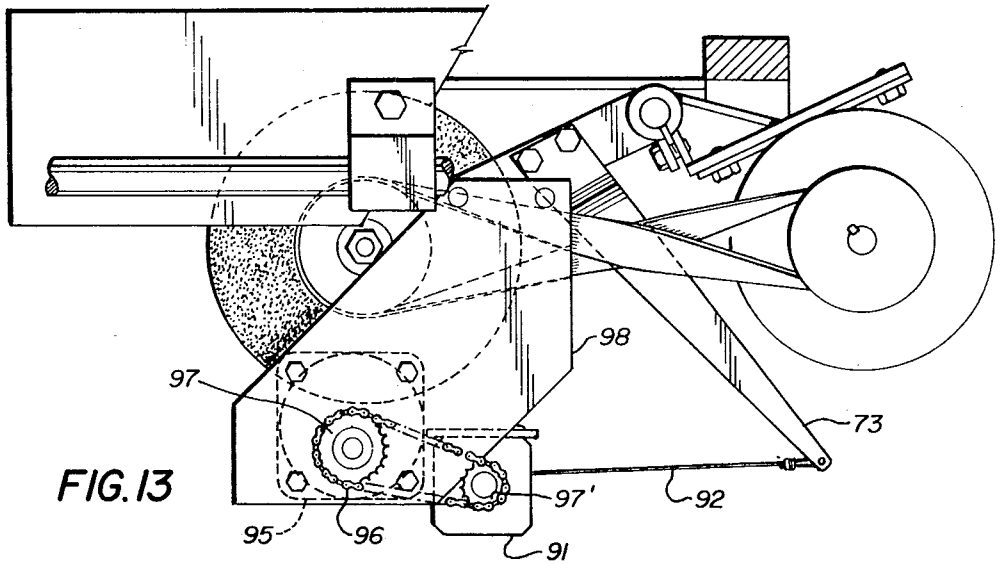
FIG. 13 is a side elevation of the hysteresis clutch assembly.

Controlled biasing of the grinding wheel 56 against the skate blade responsive to the rotational speed of the grinding wheel is achieved by means of an electrical feedback system, in which variations in torque on the electric motor 61 measurable by changes in current, phase shift and voltage drawn by such motor, induces changes in current supplied to a hysteresis clutch 91 mounted on the carriage chassis 47 coupled by cable 92 to the torque arm 73; depicted in FIG. 13.

Figure 14:
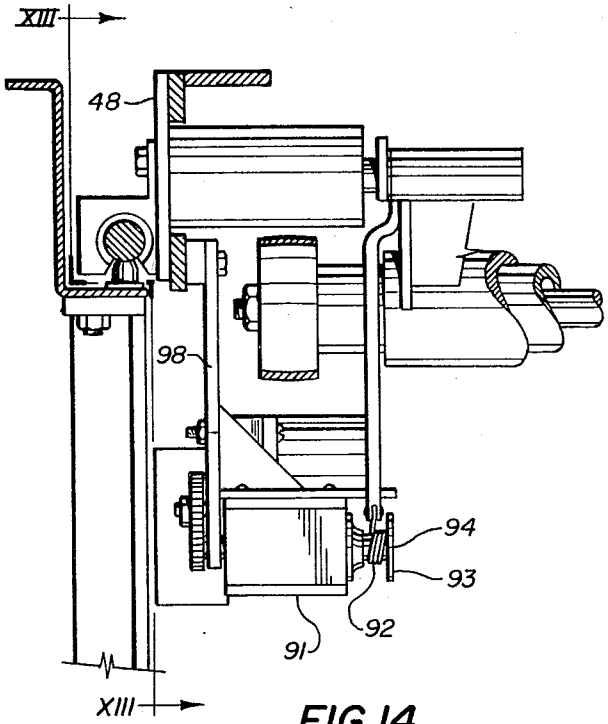
FIG. 14 is an end elevation of the hysteresis clutch assembly of FIG. 13.

Describing this hysteresis clutch assembly in greater detail, reference will be had to FIGS. 13 and 14, in which the hysteresis clutch is depicted at 91, the construction and operation of which will be well known to those familiar with the art to which this invention relates; since the specific details thereof form no part of this invention, further description thereof is deemed unnecessary. A spool 93 is mounted on the output shaft 94 of the hysteresis clutch 91 and a short length of cable 92 is provided, which is connected to the spool 93. The clutch 91 is driven by the electric motor and speed reducer 95 through the roller chain and sprockets 96, 97 and 97', FIG. 13. Motor 95 and clutch 91 are mounted to the chassis 47 by means of a mounting plate 98 bolted to the carriage chassis 47 by means of a mounting plate 98 bolted to the carriage chassis longitudinal frame member 48. An electronic multiplier, hereinafter described further with the electrical circuitry of the machine, reads the voltage, current and phase shift of the grinding wheel motor 61 and computes the current to be fed to the hysteresis clutch, as will be hereinafter explained. It will be appreciated incorporation of the hysteresis clutch with other elements of this invention eliminates any mechanical connection with the grinding wheel and drive assembly 54 other than the single pivot suspension 52, 53, FIG. 10.

Figure 5:
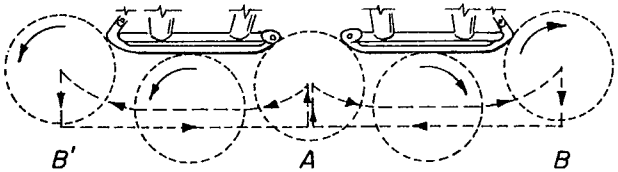
FIG. 5 is a schematic representation of the locus of travel of the grinding wheel, as it traverses the blade edge of each member of a pair of skates, then moves out of engagement with the blade, returns to the point of commencement of the stroke and resumes contact with the blade for a subsequent pass over the blade edge.

Traversing of the granding wheel carriage assembly 17 over the horizontal distance A–B and A'–B', FIG. 5, is accomplished with a conventional double-acting hydraulic cylinder 99, FIG. 8, rigidly mounted on the frame of the machine as depicted in FIG. 8, and delivering reciprocating motion to the carriage assembly 17 by cable and pulley means as illustrated.

CONSOLE COVER

Figure 15:
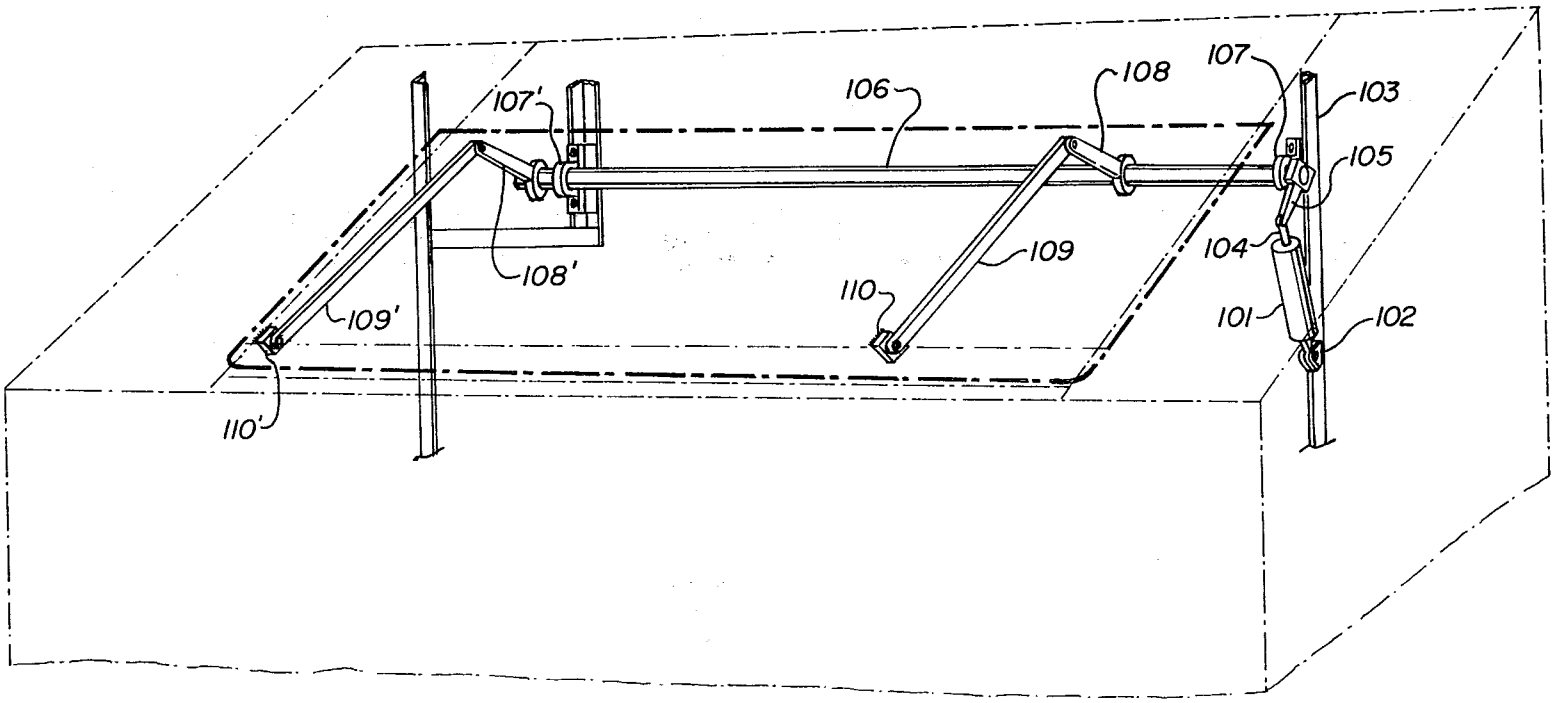
FIG. 15 is a perspective view of the shaft assembly of the console cover mechanism.
Figure 16:
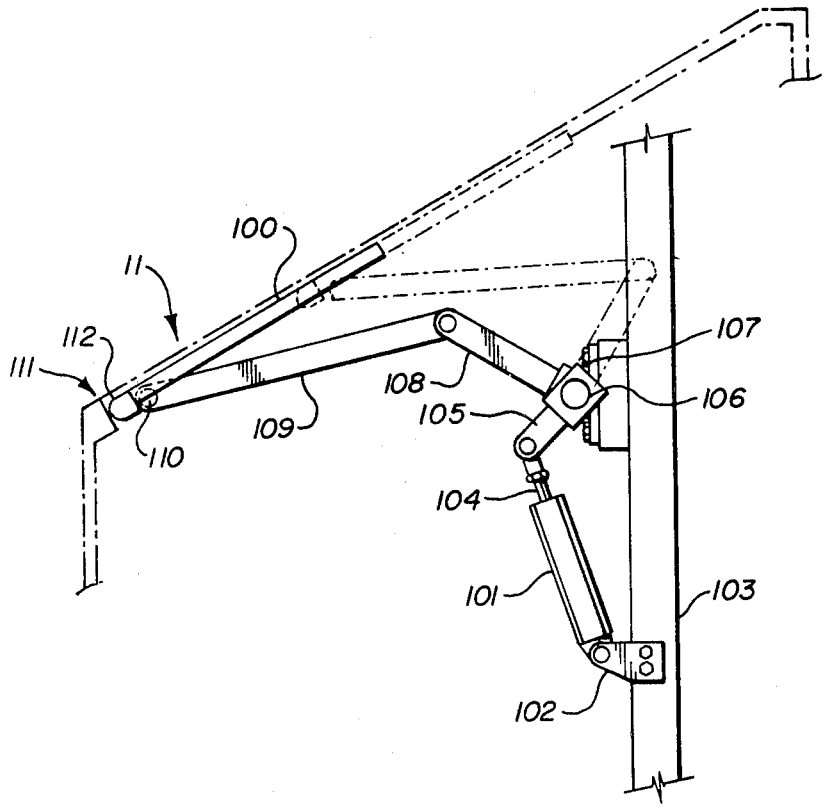
FIG. 16 is an end elevation of the console cover mechanism of FIG. 15.

Reference will be had to FIGS. 1, 15 & 16 in which the console cover 11 is depicted slideably mounted in the 100' FIG. 1 and capable of movement from an open raised position to a closed and locked lower position. The sliding cover 11 is actuated by a hyraulically operated link mechanism depicted in detail in FIGS. 15 and 16, comprising a hydraulic cylinder 101 pivotally secured at its closed end to a mounting lug 102 bolted to a console frame member 103. The piston rod 104 of the hydraulic cylinder 101 is pivotally connected to lever arm 105 of rocker shaft 106, rotatably mounted horizontally in bearings 107 and 107'. Lever arms 108, 108' are pivotally connected to links 109, 109', which links are in turn pivotally connected to the console cover 11 at pivot lugs 110, 110', FIGS. 16 and 15. Actuation of the hydraulic cylinder will thus be understood to move the console cover from its closed lower position depicted in phantom outline in FIG. 16, to its raised open position.

A microswitch, not shown, actuated by lever arm 108 when the console cover is in its closed position, is included in the logic circuitry hereinafter described, in order to deactivate the grinding apparatus until the next successive operation of the coin switch.

Affixed to the leading edge 111 of the console cover 11 is a pressure actuated tape switch 112, which when actuated, interrupts the closing motion of the console cover 11, as will be hereinafter described.

GRINDING WHEEL DRESSING ASSEMBLY

In order to produce a carefully controlled hollow grind on the skate blade, constant dressing of the edge contour of the grinding wheel 56 is necessary, and accordingly a grinding wheel dressing assembly is provided, generally designated 18, and depicted in detail in FIGS. 17, 18, 19, 20 and 21 of the drawings.

Figure 6:
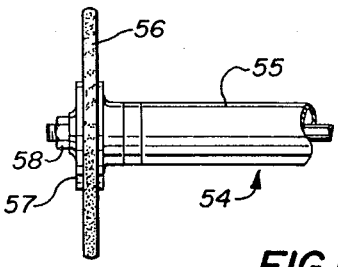
FIG. 6 is a side elevation of the grinding wheel, mounted on its spindle.
Figure 7:
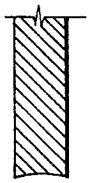
FIG. 7 is an enlarged cross-section through a skate blade, illustrating the concave edge produced by the convex grinding wheel of FIG. 6.
Figure 17:
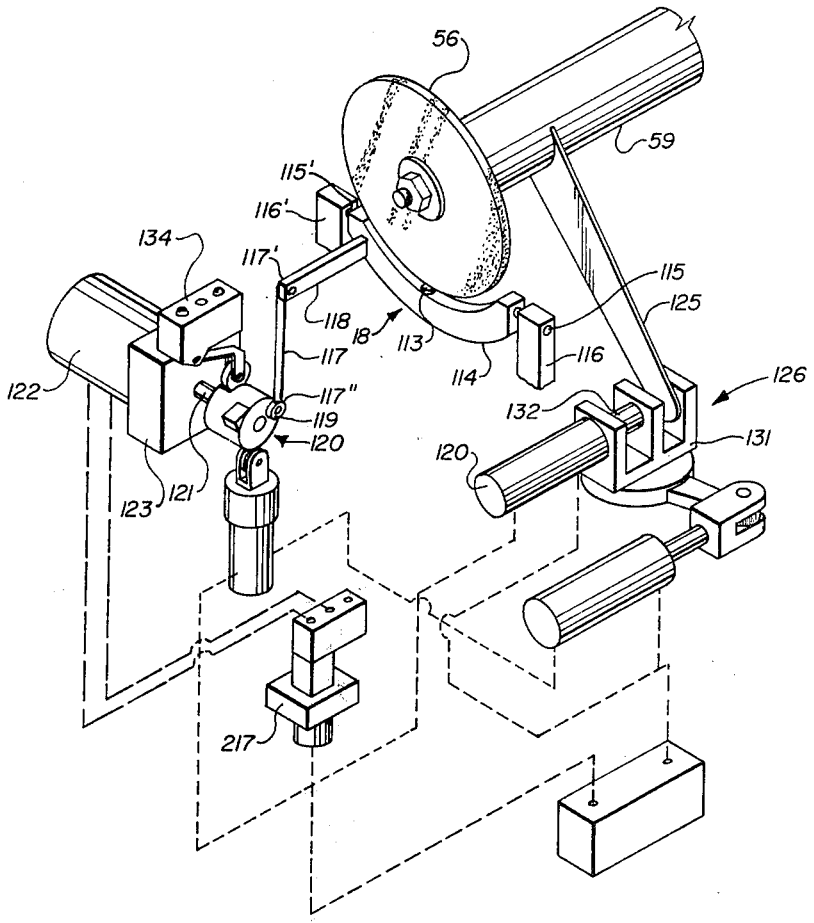
FIG. 17 is a perspective view of the grinding wheel dressing assembly.

A diamond dresser 113 is mounted in a dresser cradle 114, suspended adjacent and below the grinding wheel and drive assembly 54 by means of trunions 115, 115' and trunion posts 116, 116', FIGS. 17 and 18, positioned vertically above the diamond dresser 114 as it pivots in the trunions 115, 115', will define the profile of the transverse arc of the edge of the grinding wheel 56, FIG. 6. The dresser cradle 114 is mounted at a slight angle to the plane of the grinding wheel 56, so that the trunion posts 116 are laterally offset sufficient to permit unrestricted horizontal longitudinal travel of the grinding wheel 56 as it moves in its locus of travel throughout its working cycle, FIG. 5. Rotation of the cradle 114 through its dressing arc is provided by the link 117, FIG. 17, pivotally connected at one end 117' to an arm 118 secured to the cradle 114, and pivotally connected at its other end 117'' to a cam and crank assembly, 119, 120, FIGS. 17 and 19. This cam and crank assembly 120 is mounted directly on the output shaft 121 of an electric motor 122 and speed reducer 123, secured to a frame member 124 of the machine.

Figure 19:
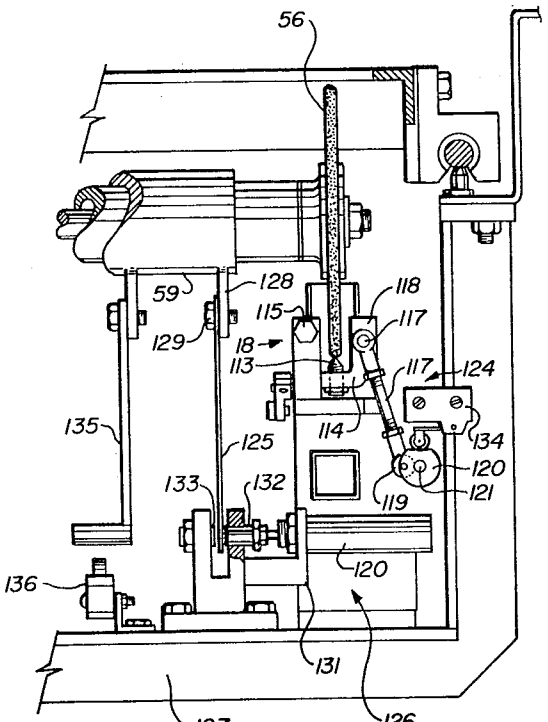
FIG. 19 is an end elevation of the dressing assembly of FIG. 17.

In order to lock the grinding wheel 55 rigidly for the dressing operation, hydraulic clamping of the grinding wheel is provided by means of a downwardly depending locking arm 125, attached to the grinding wheel bearing, which is engaged by a hydraulically operated locking means 126 mounted on the machine frame on a cross member 127, FIG. 19. Proceeding now to describe this clamping assembly in detail, reference to FIG. 17 depicts the downwardly depending locking arm 125, secured to the grinding wheel bearing 59, by means of a mounting lug 128 and locking bolt 129. Hydraulic cylinder 120, secured to mounting bracket 131, has at its active and locking pin 132, which holds the end of the locking arm 125 against stationary locking pad 133 similarly rigidly mounted on the cross member 127.

Figure 20:
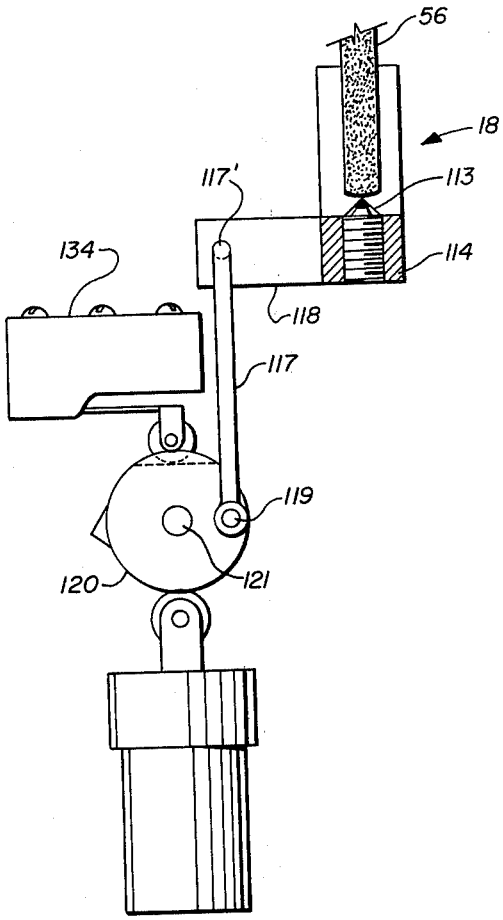
FIG. 20 is an end elevation in isolation of the cam mechanism of the dressing assembly of FIG. 17.
Figure 21:
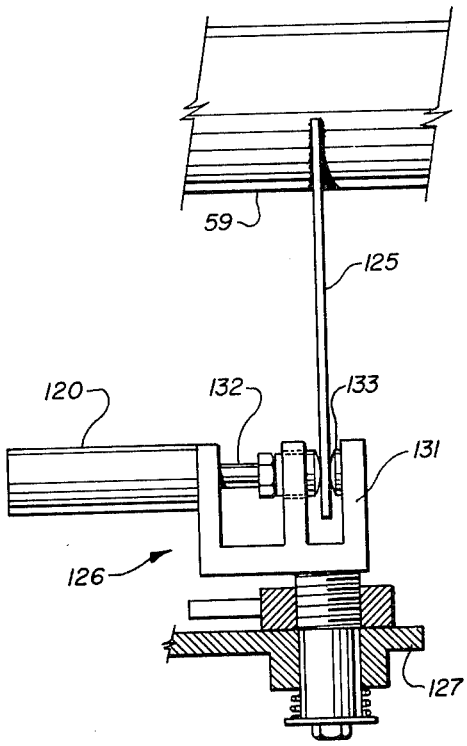
FIG. 21 is a side elevation in isolation of the clamping mechanism of the dressing assembly of FIG. 17.

A microswitch 134, mounted adjacently above the cam and crank assembly 120, FIGS. 18, 19 and 20, engages the cam and crank assembly 120 at the end of its dressing cycle, to actuate the switch 134 and thereby open the power supply to the dresser motor 122 and the grinding wheel motor 61 at the lowest point of the arc of travel of the diamond dresser 113, thereby positioning the diamond dresser 113 in its "rest" position at the median point of the grinding wheel 56, as depicted in FIGS. 19 and 20.

Figure 23A:
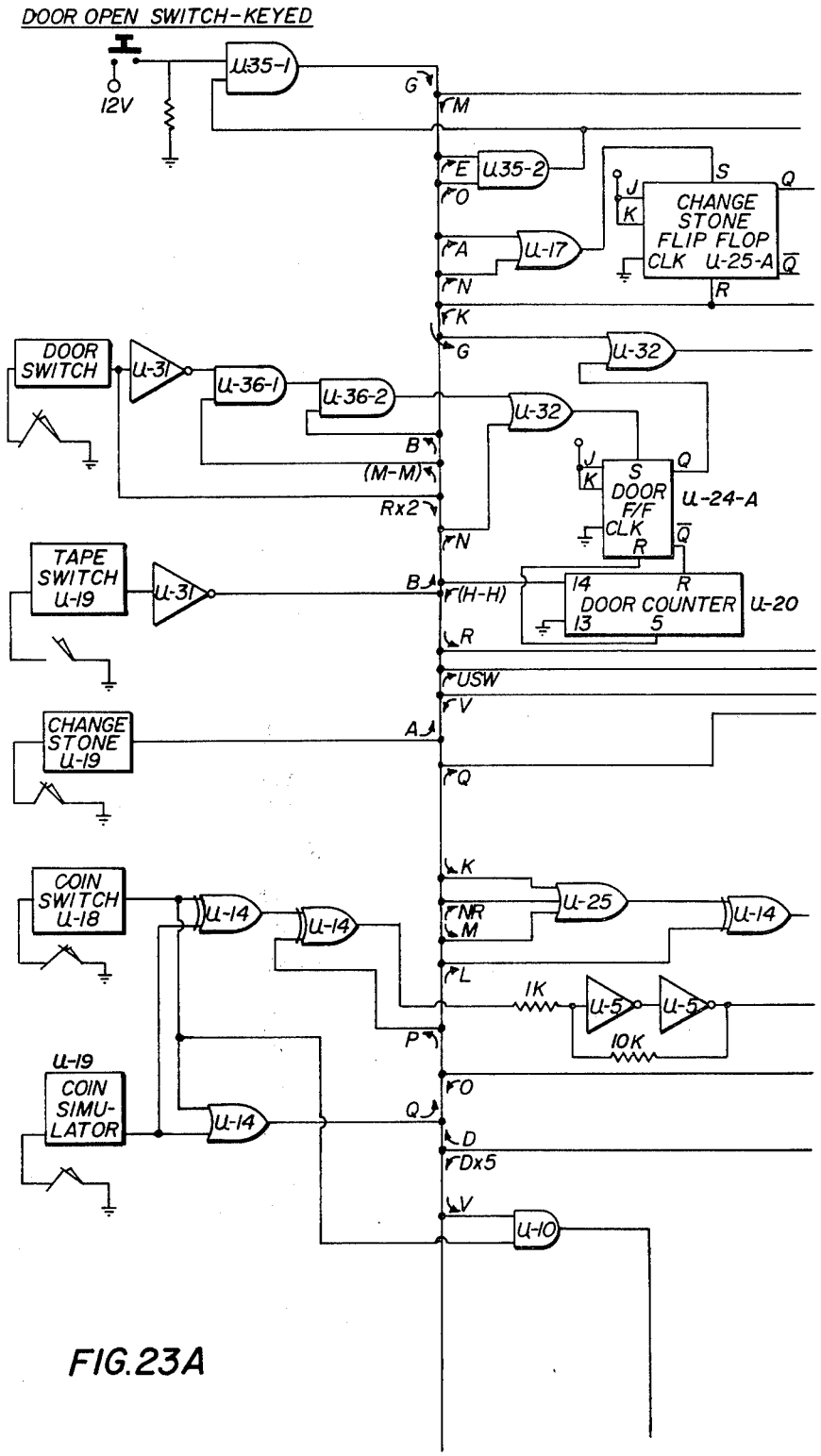
Figure 23B:
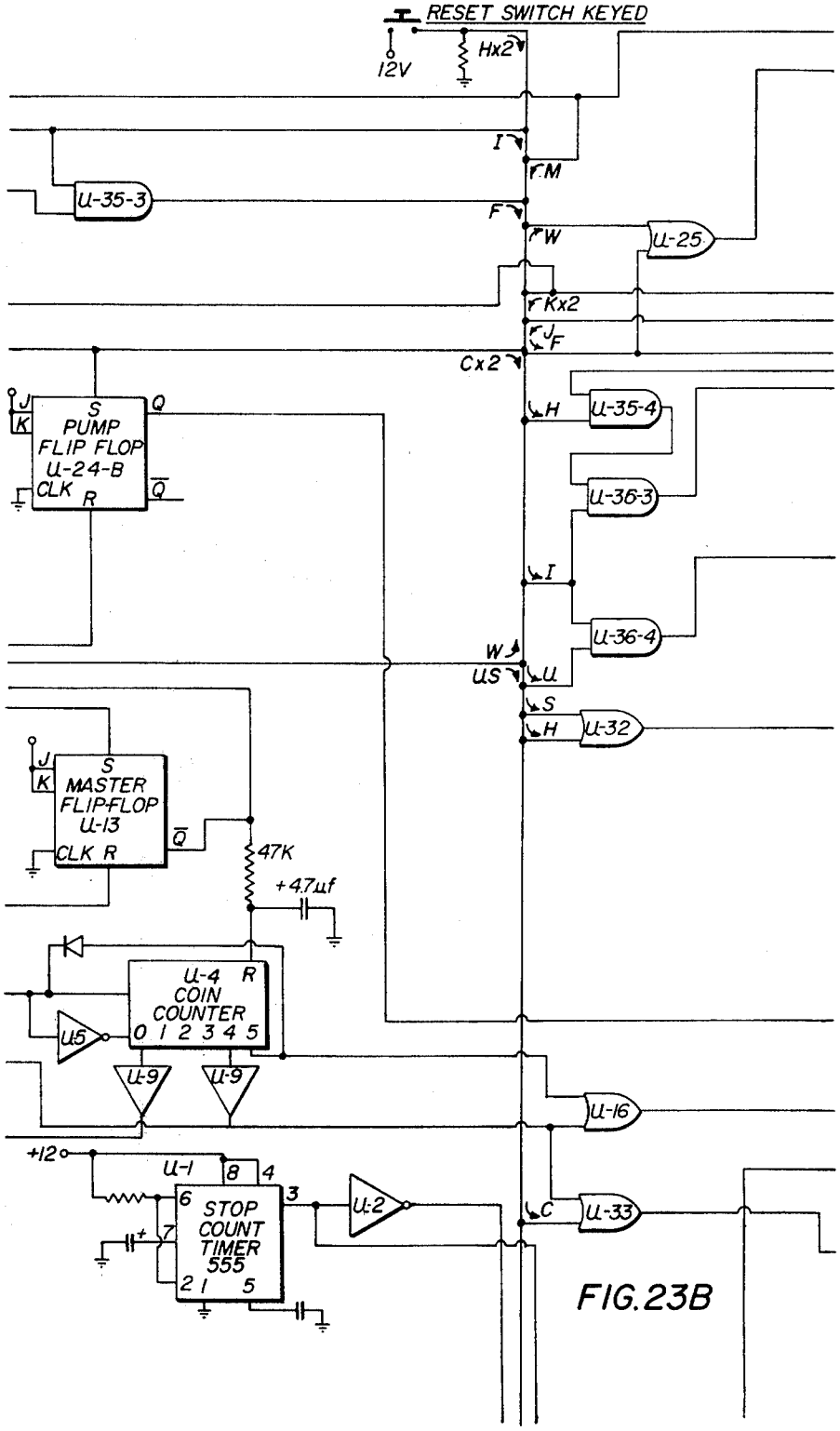
Figure 23C:
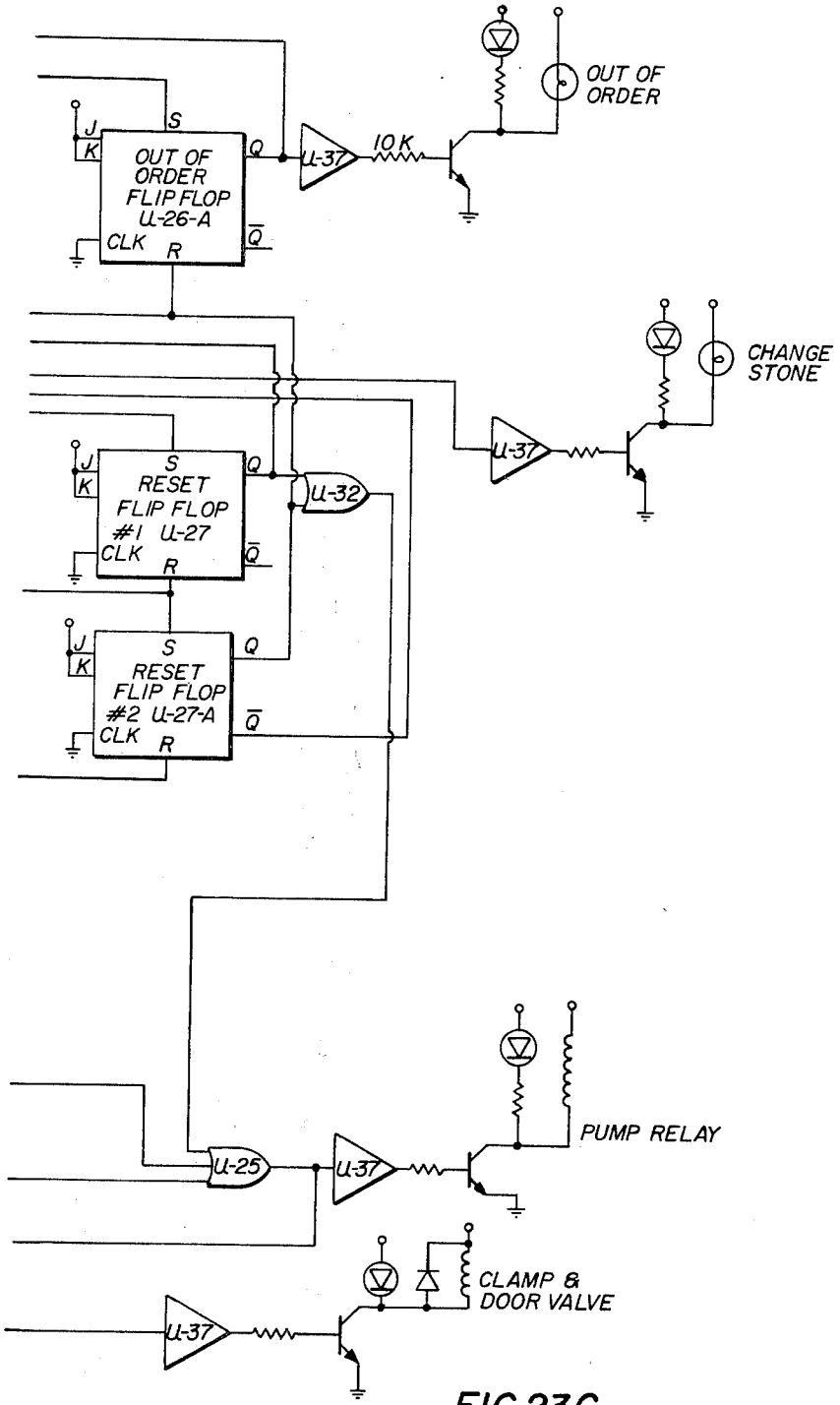
Figure 23D:
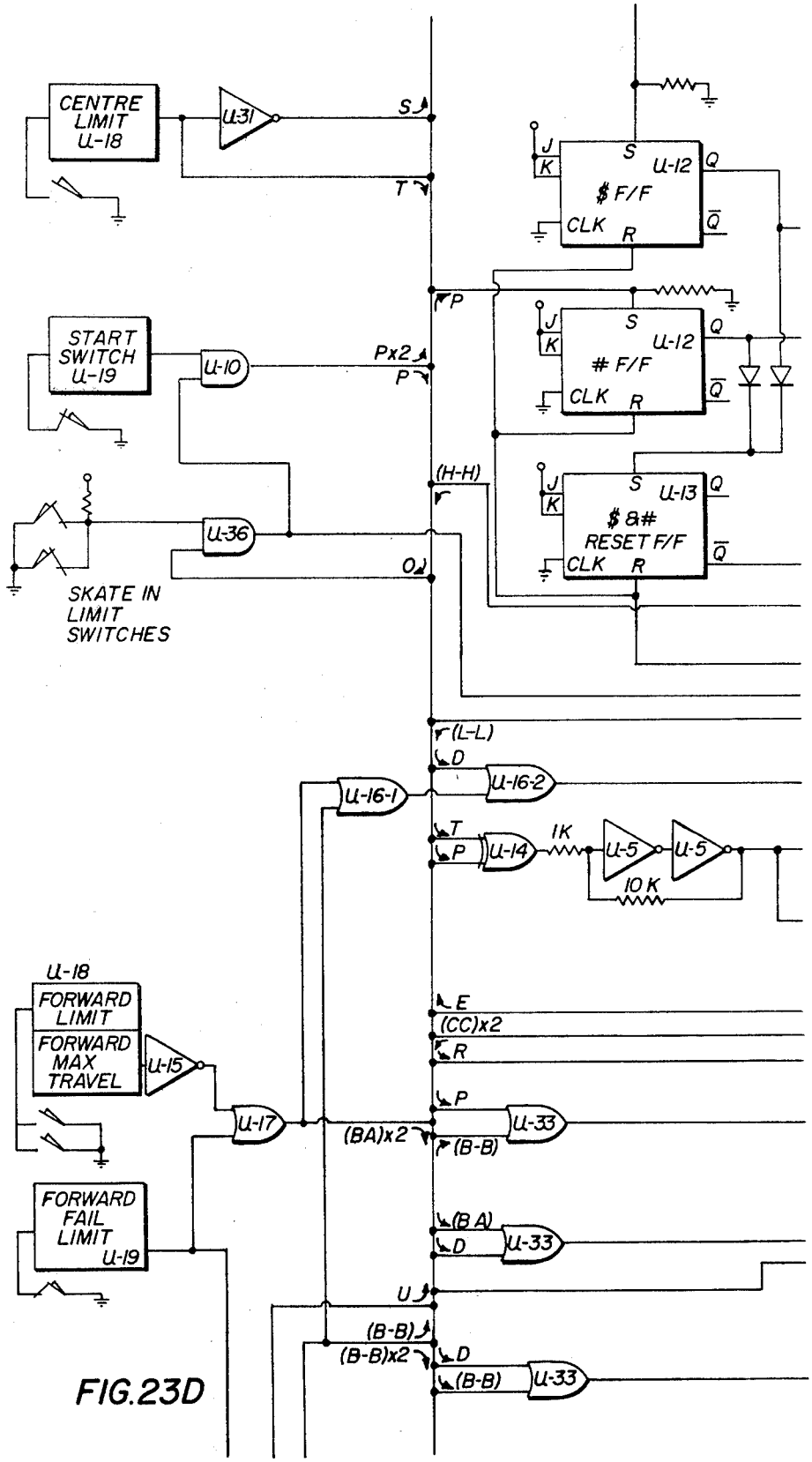
Figure 23E:
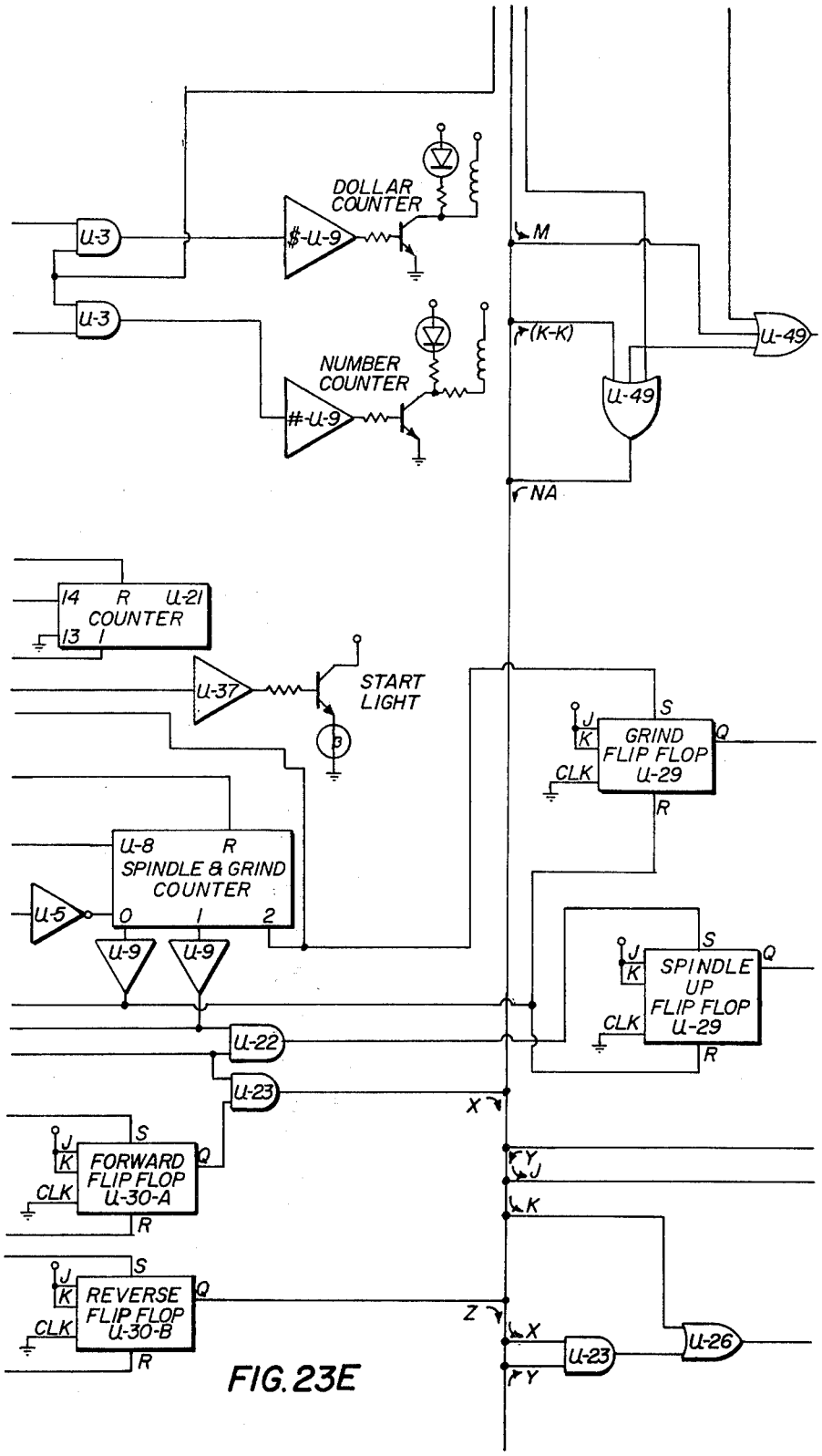
Figure 23F:
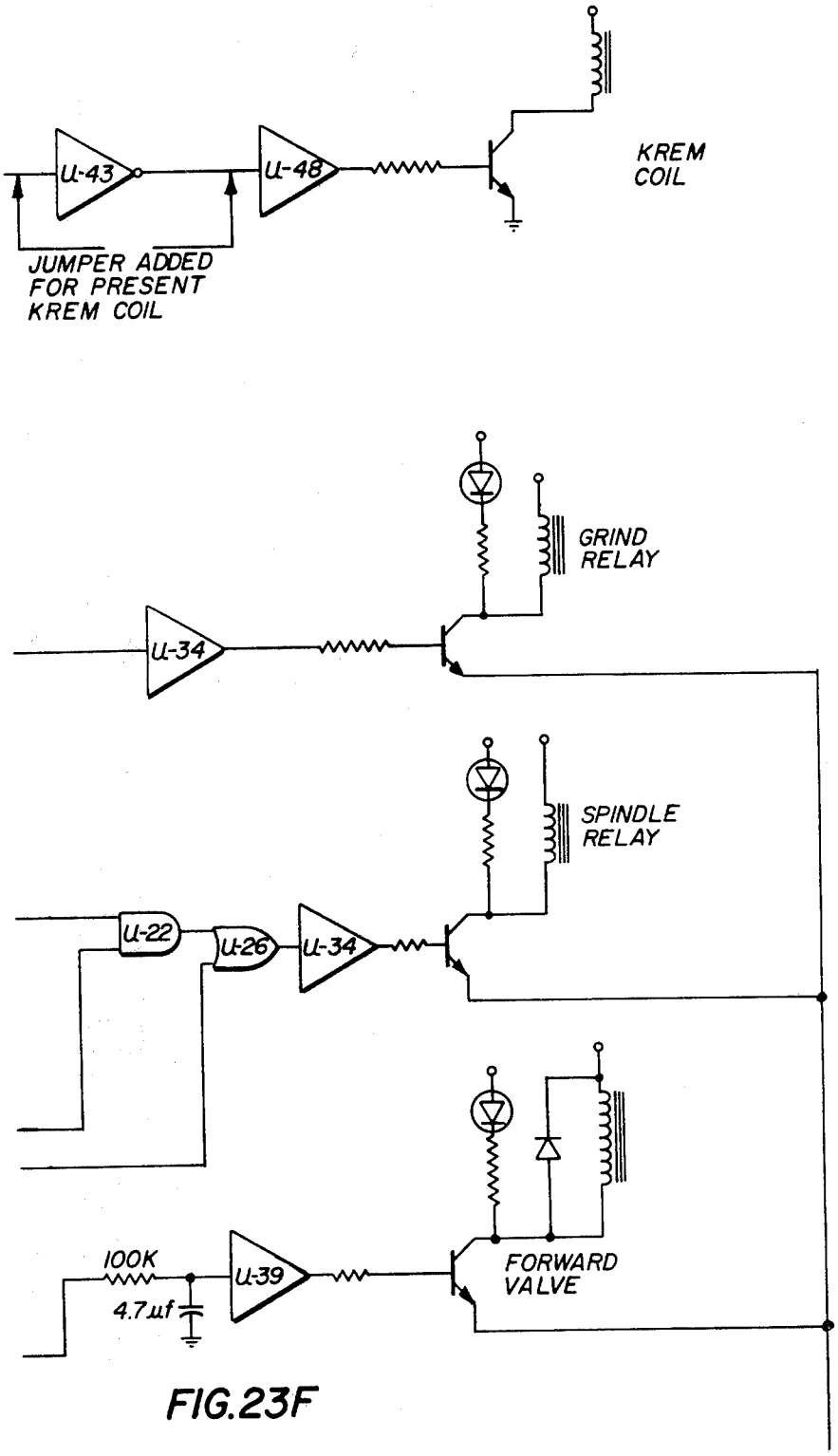
Figure 23G:
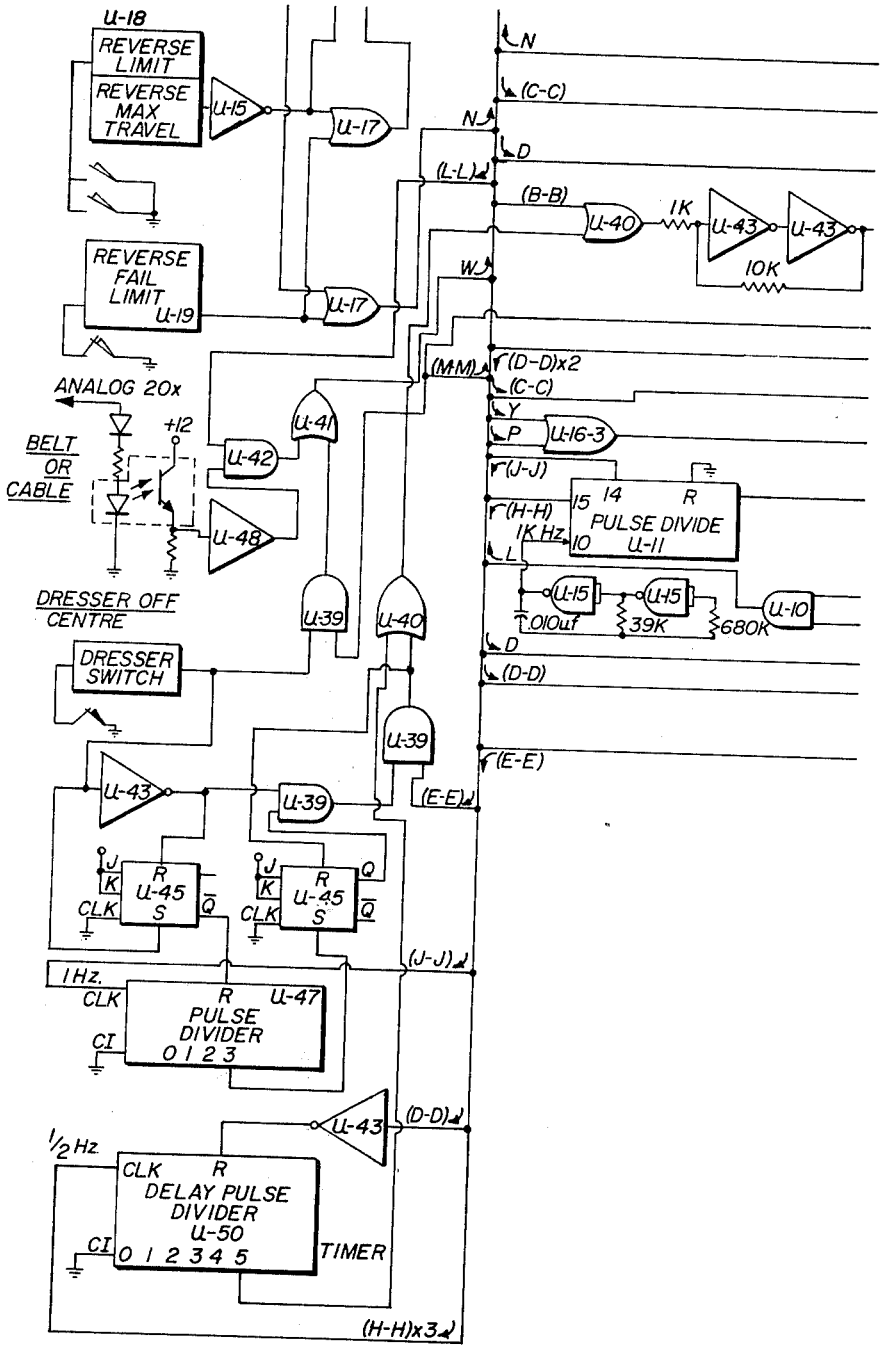
Figure 23H:
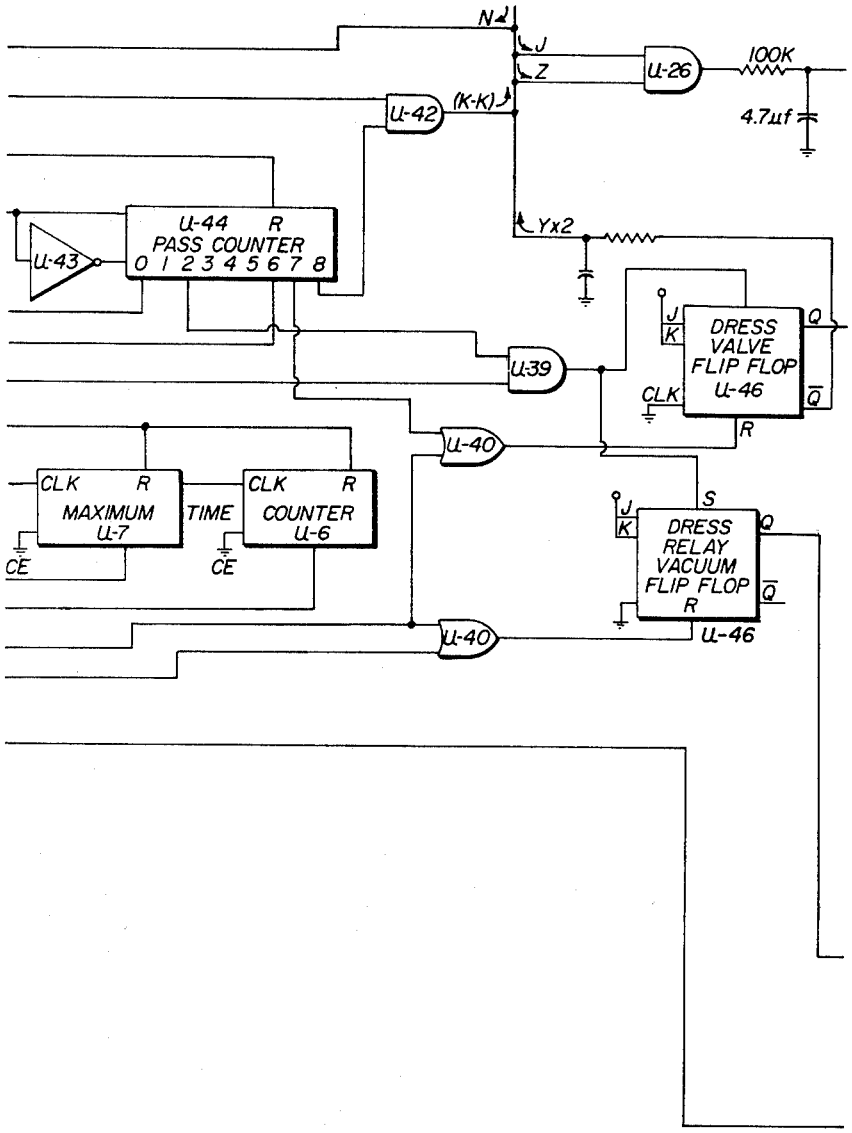
Figure 23I:
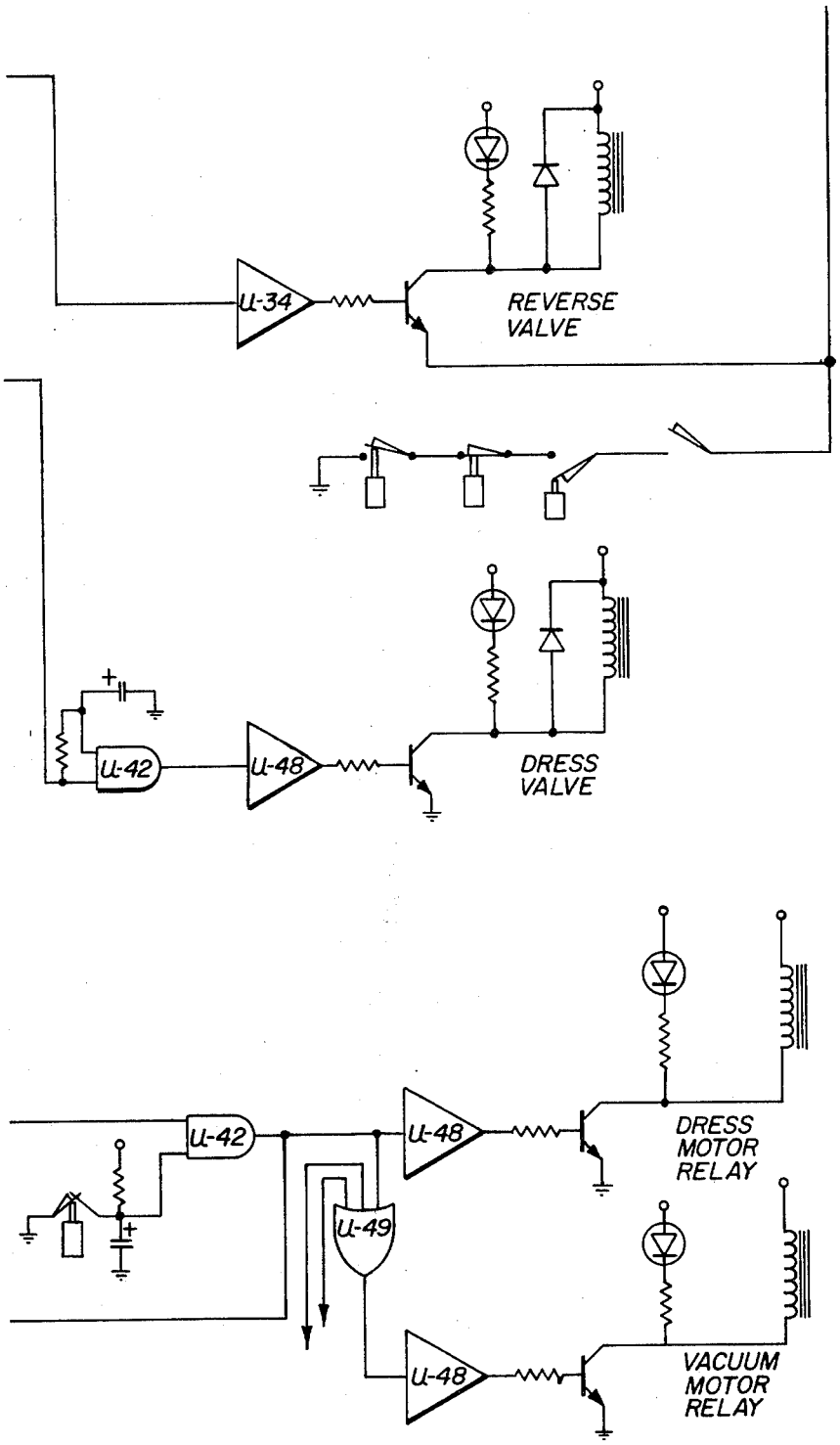
Figure 23K:
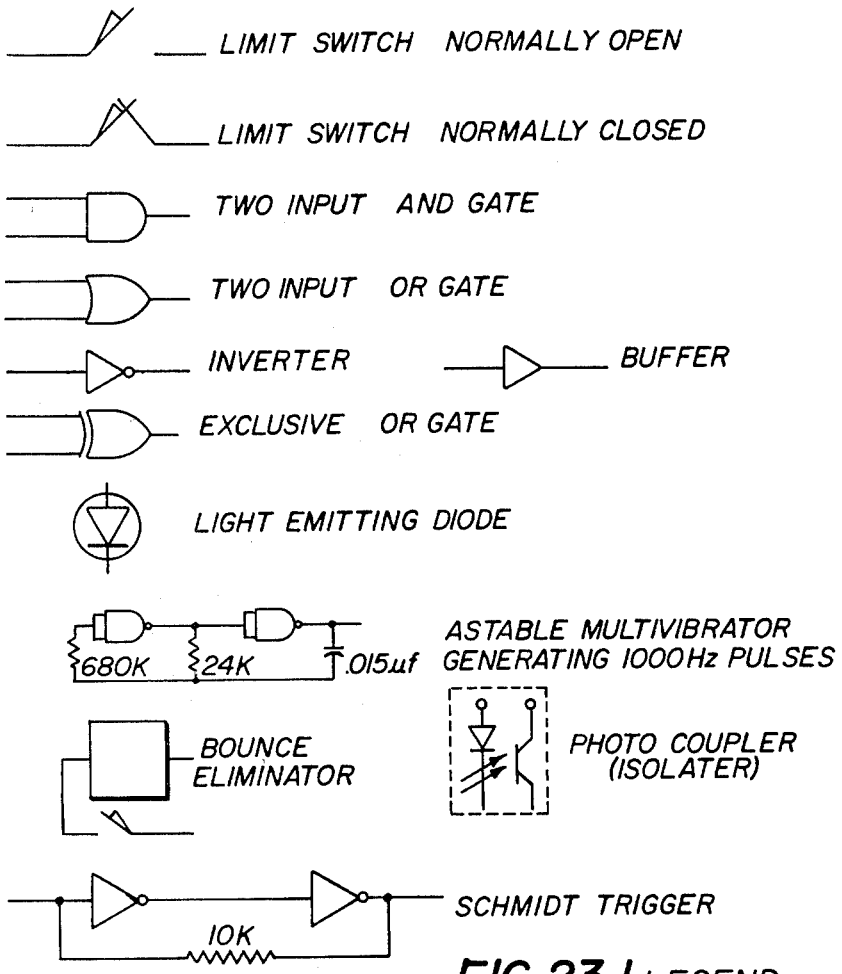

Means is provided to deactivate the machine when the grinding wheel 56 is reduced in diameter to an extent that acceptable skate blade grinds are no longer assured. A "small stone" tripper arm 135, FIG. 19, secured to the grinding wheel bearing 59, in downwardly depending relationship, and a registering microswitch 136 mounted on the frame cross-member 127, cooperate to close an auxiliary electrical circuit and illuminate a "Change Stone" FIG. 23C, light associated with switch 134, FIG. 19, as an indicator to the attendant.

HYDRAULIC SYSTEM

Figure 8B:
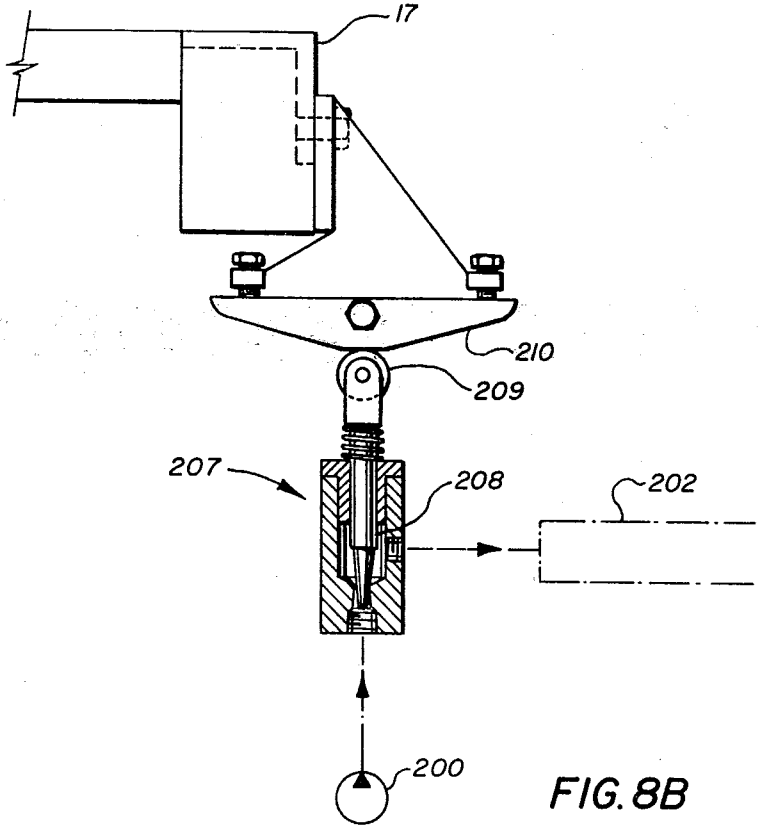
FIG. 8B is a detail of the throttle valve in the hydraulics powering the grinding wheel carriage assembly.
Figure 22:
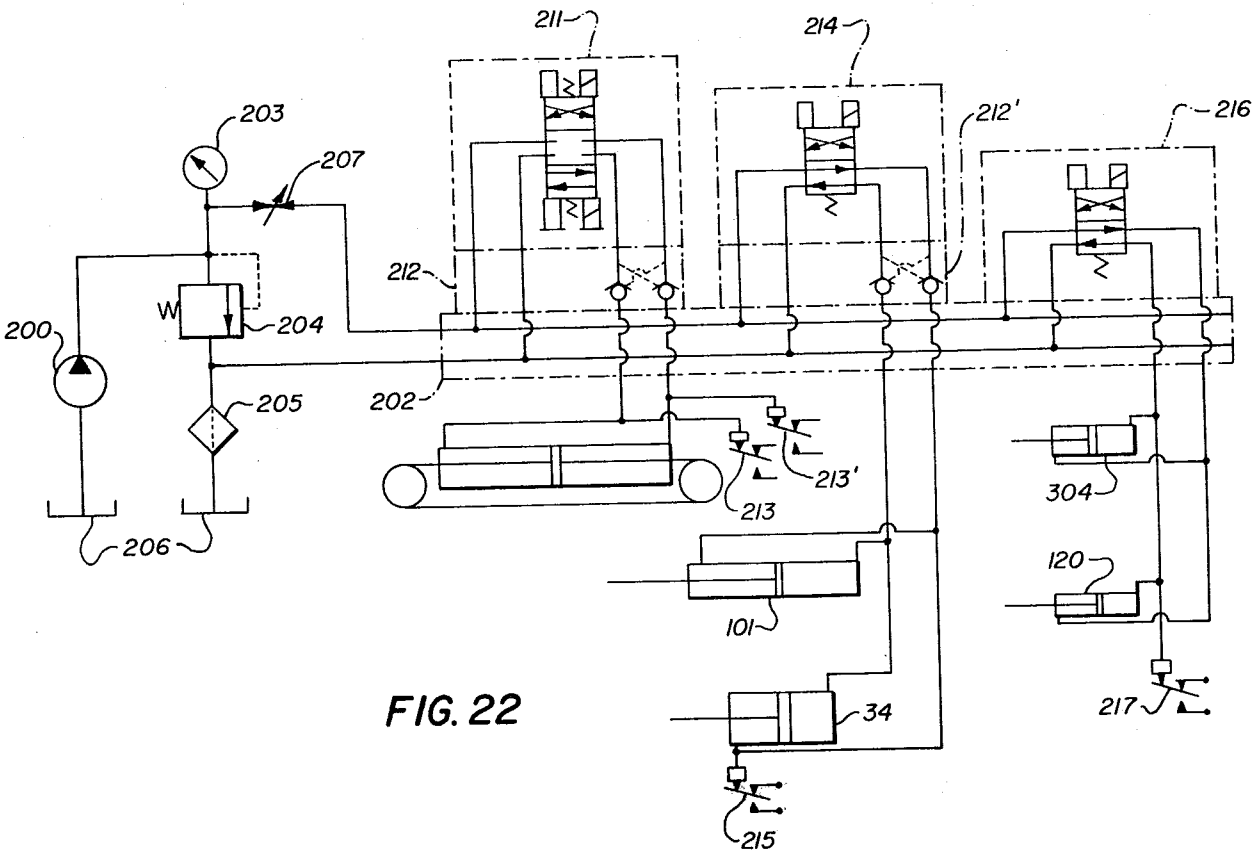
FIG. 22 is a schematic of the hydraulic circuits of the skate blade sharpener.

Reference will now be made to FIG. 22, which schematically depicts the hydraulic system of the invention. A hydraulic pump 200, driven by electric motor 201, FIG. 8, provides hydraulic power to a manifold 202, system pressure being indicated by pressure gauge 203 and maximum pressure being limited by a relief valve 204 and by-pass return 205 to a hydraulic reservoir 206. A main hydraulic throttle valve 207 is provided between the pump 200 and the manifold 202, actuated by a control rod 208 and roller 209, FIG. 8B, which engage a double cam 210 mounted on the grinding wheel and drive assembly carriage 17, which is so positioned and proportional as to reduce the linear velocity of the grinding wheel 56 relative to the skate blade on the heel entry of the grinding wheel, as well be hereafter explained.

A first hydraulic control valve 211 connected to the manifold 202, is a 4-way 3-position valve, from which hydraulic fluid is directed, in its first position, to a dual pilot-operated checkvalve 212, which ensures that the carriage will remain in locked condition until the manifold 202 is energized. The downstream side of the checkvalve 212 is connected to the carriage traverse cylinder 99, FIG. 8 which causes the carriage to recriprocate during the grinding operation; each of the two hydraulic lines powering the traverse cylinder 99 are equipped with pressure switches 213, 213', which are connected to shut down the system if the hydraulic fluid pressure exceeds a predetermined maximum value for the system in the event of malfunction.

A second hydraulic control valve 214 connected to the manifold 202 is a 4-way 2-position valve feeds hydraulic fluid firstly through a dual pilot-operated check 212', to cylinder 101 of the console cover assembly, heretofore described, and also to hydraulic cylinder 34 of the skate blade clamping assembly 14, also heretofore described. A maximum pressure switch 215 is included on this line as well, to indicate a predetermined fluid pressure has been reached in the skate clamp cylinder 34, before the apparatus can proceed to the next stop in the cycle, as hereinafter explained.

A third hydraulic control valve 216 connected to the manifold 202 is also a 4-way 2-position valve which feeds hydraulic fluid to the dressing assembly cylinder 120 and 304 and heretofore described, which operate, respectively, the spindle clamp means and the dressing assembly dust collector, hereinafter described. Pressure switch 217 is installed in this hydraulic sub-system to ensure that the spindle clamp is activated before the grinding wheel cycle commences.

DUST COLLECTING ASSEMBLY

Grinding dust, generated during the skate sharpening operation, and dressing dust, generated during the grinding stone dressing operation, are removed by vacuum collecting means, as will now be described. Reference to FIG. 8 depicts a vacuum system 19 comprising a vacuum pump and electric motor assembly 300 mounted on the base of the main frame of the machine, flexible vacuum line 301 leading to the grinding wheel dressing assembly 18 and the grinding wheel carriage assembly 17. A fixed dust-collecting nozzle, 302, FIG. 9, is positioned adjacent the grinding wheel 56. A moveable dust-collecting nozzle 303, FIG. 18, is brought into operating position during the grinding wheel dressing cycle and reference to FIG. 18 will now be made for details of the associated operating mechanism. A hydraulic cylinder 304, mounted on lower frame member 127, extends upwardly inclined, and is connected at its piston rod end 305 to an arm 306, connected to horizontal shaft 308 pivotally mounted on the dresser frame at 309, FIG. 18. Secured to the shaft 308 is a dust catcher 303, adapted to move between its operative position depicted in solid outline in FIG. 18 and its withdrawn position depicted in phantom in FIG. 18. Additionally connected to rotating shaft 308, by means of linkage 310, lever arm 311 and pivot arm 312 is horizontal shaft 313, mounted on the dresser frame at 314 for rotation, to which is secured a damper blade 315, FIG. 18, adapted to direct the flow of vacuum driven air from the dust catcher 303 by blocking off the extension of the vacuum line 301 to the grinding wheel carriage assembly 17. When cylinder 304 is in its retracted position, dust catcher 303 is lowered, as depicted in phantom in FIG. 18, and damper blade 315 is rotated to close off the flow of vacuum air from the dresser assembly 17, thereby directing the vacuum air to the grinding operation.

SWITCHES, FAIL-SAFE AND PROTECTIVE DEVICES

Reference to FIG. 3 discloses a pair of micro switches 43 and 44 mounted on a toe switch mount plate, 43', 44' secured to the under side of the toe clamps 41. The first switch 43 is adapted to engage the grinding wheel carriage assembly 17 after the toe of the skate blade has been ground, thereby terminating the traverse of the carriage assembly 17, thereafter to reverse its direction of travel as directed by the logic, as will be hereinafter explained; switch 44 is adapted for overtravel protection in the event of failure of the switch 43, to shut down the entire machine in an "Out of Order" condition.

Considering now the switch gear on the grinding wheel carriage assembly 17 reference is made to FIG. 9, depicting the carriage assembly 17 in plan, with a longitudinal switch tripper mounting plate 401, bolted to the top of the carriage assembly 17, which carries switch trippers 402 and 403, which are adapted to engage with micro switches 44 and 43 just described.

Also mounted on mounting plates 401 are switch trippers 404 and 405, FIG. 9, which activate a centre switch 406, rigidly mounted centrally on the machine frame and depicted in FIG. 3, which causes the grinding wheel spindle assembly to rise into engagement with the skate blade when tripper 404 engages the centre switch 406; tripper 405 causes the spindle motor 61 to start when the centre switch is activated by it.

Reference has heretofore been made to the tension-activated switch 35 in the hydraulically operated clamping assembly 14. The switch 35 is spring loaded to a pre-determined tension at which point it will close. A second pressure activated switch 215, FIG. 22, included in the blade clamp hydraulics, must also close, indicating that the blade clamps are delivering pressure against the skate blades, before the machine will start its grinding cycle. When the hydraulic pressure on the clamping assembly 14 is released, the spring loading will open the moveable clamp members 25, permitting the finished skates to be removed.

Two additional micro switches 407 and 408, FIG. 3, which, respectively stop the traverse of the carriage at the end of the grinding of the toe of the skate blade, then reverse the direction of travel of the carriage for its return to the centre position A, FIG. 5.

ELECTRICAL CONTROLS

Figure 24:
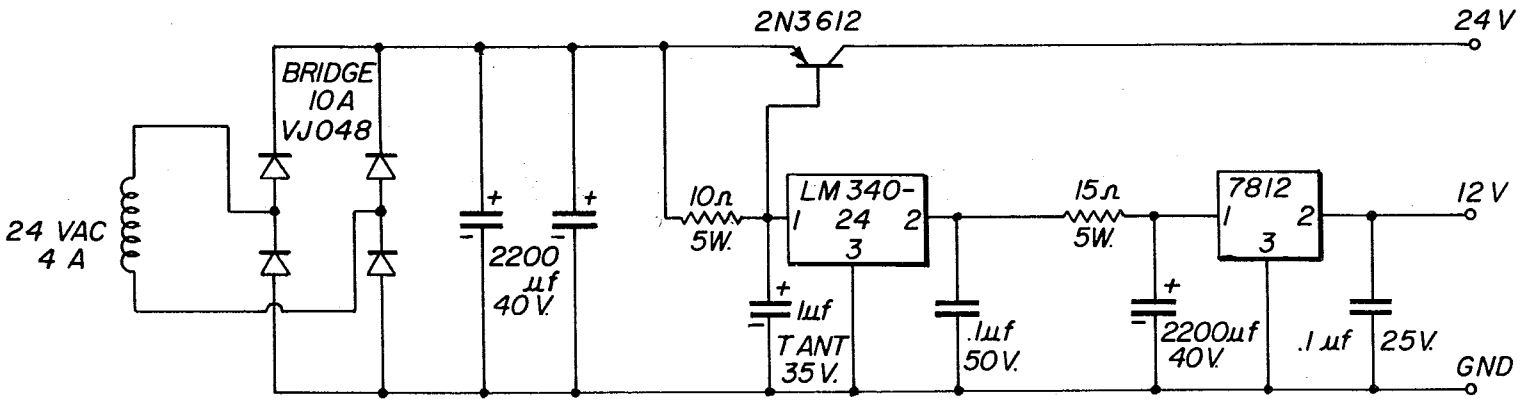
FIG. 24 is a schematic of the electrical power supply of the skate blade sharpener.
Figure 25A:
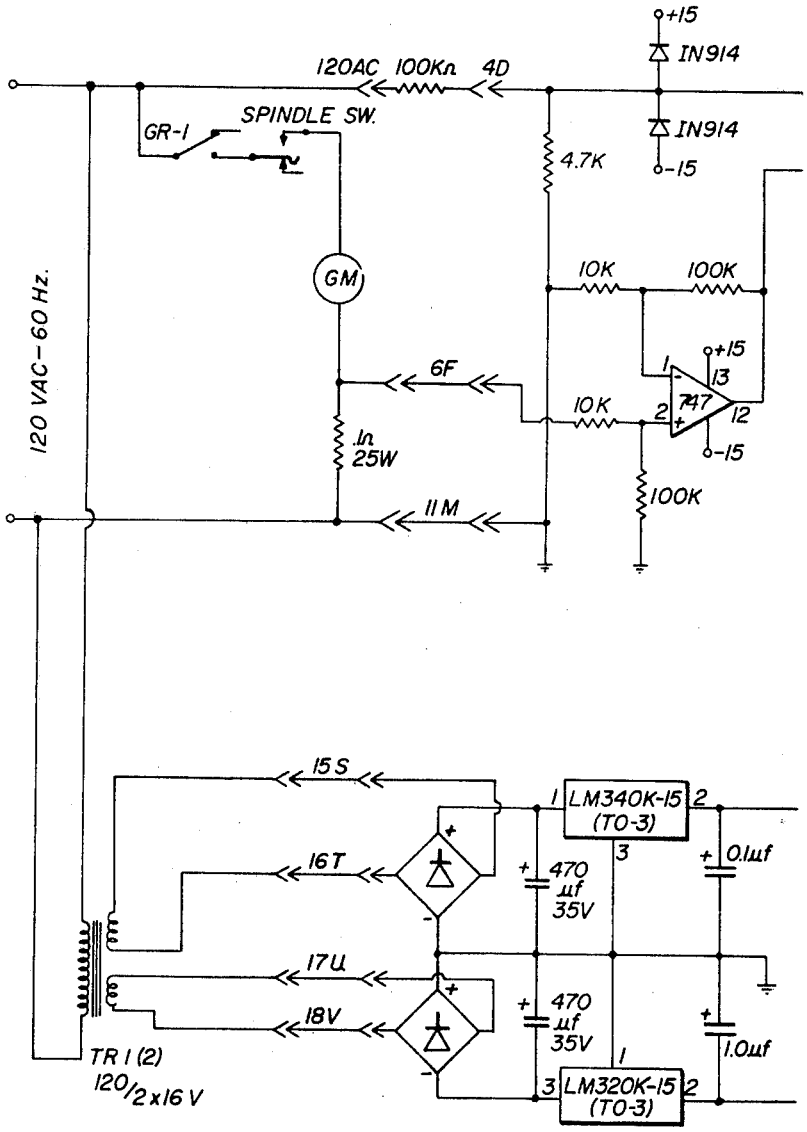
FIGS. 25A–D shows a schematic of the analog signal multiplier circuit.
Figure 25B:
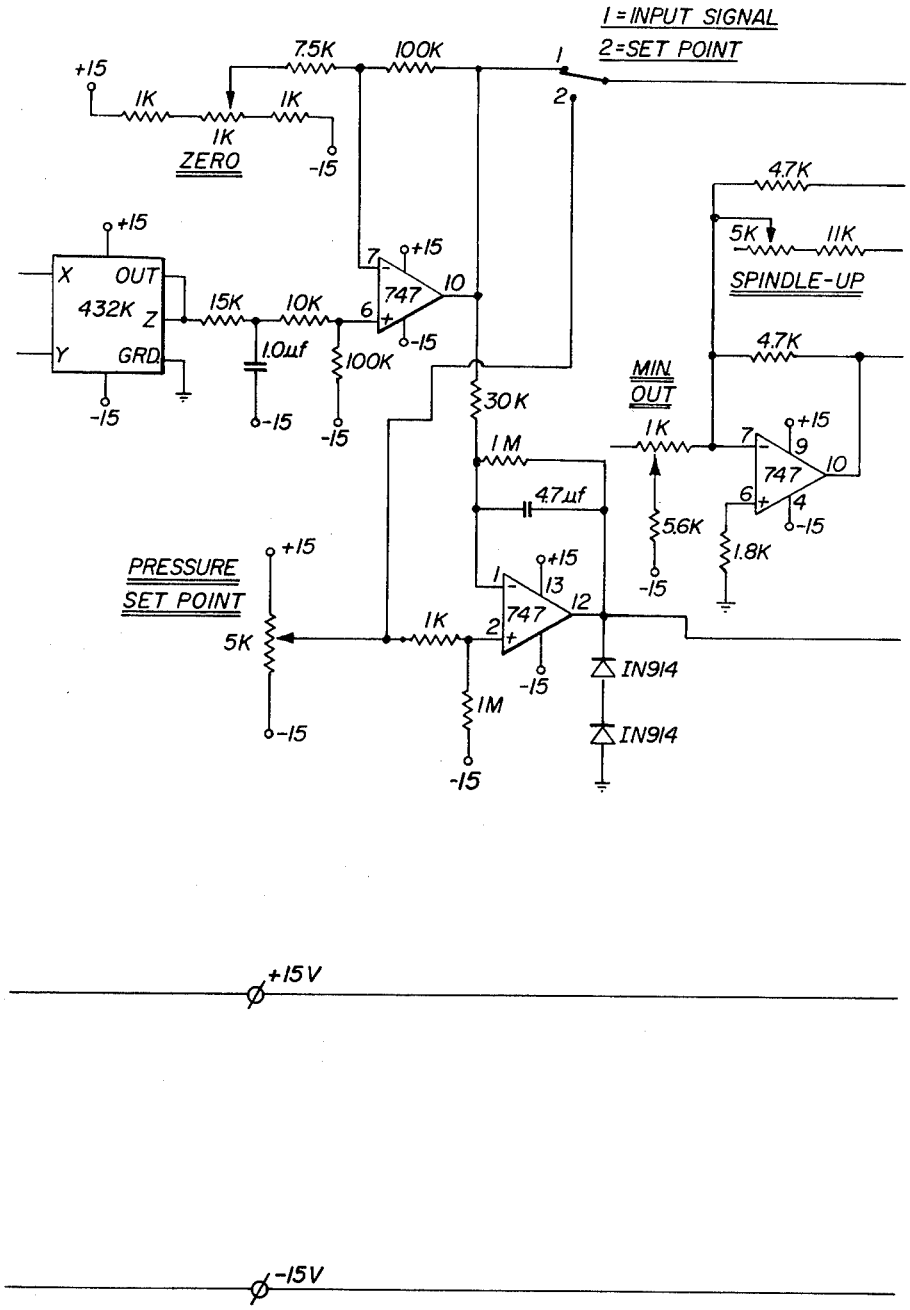
Figure 25C:
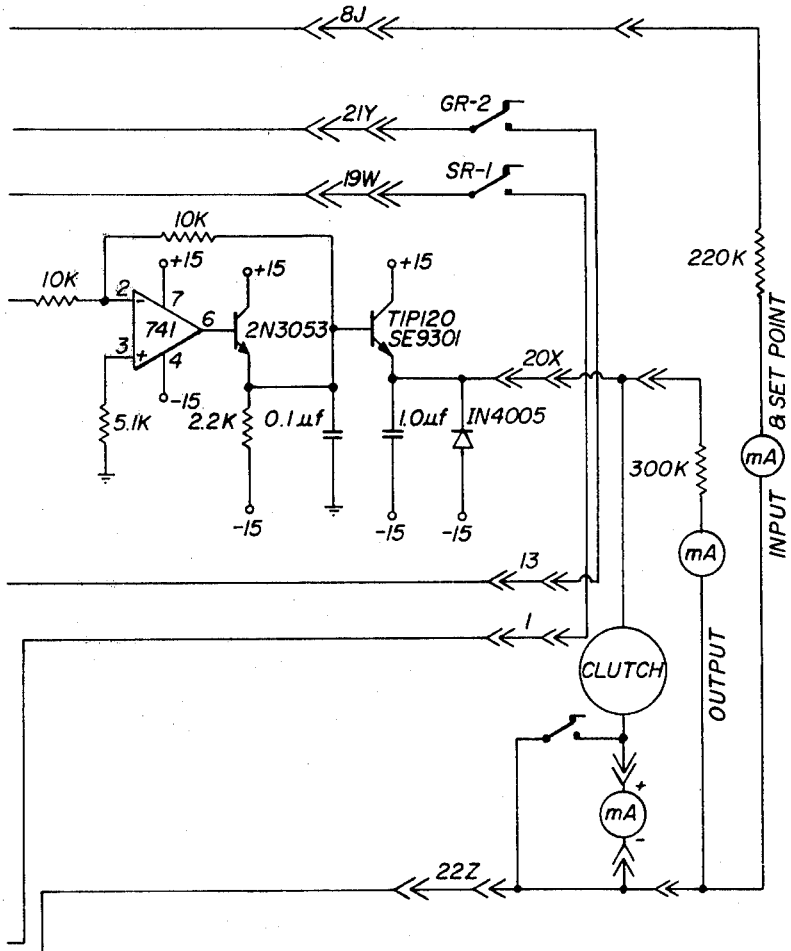
Figure 25D:
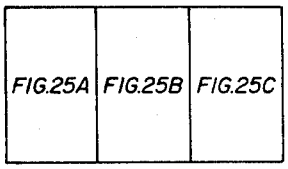

FIG. 23 illustrates an electrical control circuit, FIG. 24 illustrates a power supply circuit and FIG. 25 illustrates an analog signal multiplier circuit, for the skate sharpener described in the foregoing embodiments, automated by a combination of circuits and micro-switches. The electrical circuitry shown in FIGS. 23, 24 and 25 will now be described, but it will be appreciated that variations in the electrical circuitry and operation of the apparatus may change without departing from the scope of the present invention.

It will be noted from the circuit diagram of FIG. 23 that various limit switches, relays, transistors, and other electrical components are given references which include letters indicating names allotted to the circuit components. These items are identified in the legend accompanying FIG. 23.

Electrical power is supplied through a conventional dual 15 amp. breaker mounted within the machine and fed from a 30 amp. 115 volt single phase circuit. 115 volts AC is used to operate all motors, which are switched on/off by relays, energized by 24 volt DC coils. The power supply furnishes and regulates 12 volt DC for the logic and grinder controls and 24 volt DC to operate relays. The Grinder Control circuit described below has its own ±15 volt supply.

GRINDER CONTROL

The grinder is designed to remove a uniform amount of material along the length of the blade. This is accomplished by measuring the torque on the grinding motor 61 which is a function of the voltage across the motor, the current being drawn by the motor and the phase relationship between these two factors. Use is made of an analog signal multiplier circuit, FIG. 25, coupled with an adjustment set point voltage and comparator element to provide an input signal to the hysteresis clutch 91 which couples a fractional horsepower AC gearmotor 95 to the small diameter spool 93, which biases against the unbalanced weight to the grinding wheel and drive assembly 54 and also produces sufficient tension load on cable 92 to hold the grindstone against the work. The grinding wheel 56 will thus be made to rise on command and bias upwardly against the work with sufficient force to cause a determinable amount of steel to be ground away from the skate blade with each pass.

LOGIC CIRCUIT

The logic circuitry makes use of conventional solid state devices to provide the proper sequencing of the components of the apparatus, and additionally controls the functions that limit the chance of a bad grind or other damage to the skates. Additionally, the logic circuitry provides for the counting of coinage fed into the machine.

The logic diagram, FIG. 23, will be familiar to those to whom this specification is directed, and only a general description of elements present and their purpose will now be provided.

(a) Door Open and Reset Switches

Since the console of the machine must remain locked, limited access to an attendant is necessary under special conditions, such as power failure during a grind with resulting loss of logic, or a malfunction resulting in skates remaining locked in the machine. Two key-operated switches are provided which may be operated with a key, but not until a cycle is completed.

(b) Out of Order

Upon the occurence of an event which prevents a cycle from completing within a maximum allowed time, a timer U6 and U7 times-out and calls up an "out of order". If the malfunction is due to a main power interruption, then the "door open" key can be used to remove the skates and the "reset" turned to bring the machine and the logic back to "start" position.

(c) Change Stone

A limit switch detects a stone getting too small and calls up an "out of order" and "change stone" light. Under these circumstances the coin acceptor is plugged, and the machine will not accept coinage. After a new stone is installed, the machine is reset.

(d) Tape Switch

This element, indicated at 112, FIGS. 1 and 16, mounted on the leading edge 111 of the door 11, is a precaution, in the event the door is closing and contacts an object, the tape switch will close and the door will reopen and close again after a set interval.

(e) Coin Switch and Coin Simulator

A solid state counter is fed a pulse with each coin. The coin simulator is a parallel switch, positioned inside the machine and may be used to start the machine rather than using coinage. When the counter has sensed the preset number of pulses, the hydraulic pump 200 is started by energizing the pump relay; additionally, this counter calls for the door 11 to open.

START SWITCH

The machine is equipped with an electromechanical counter that records the number of grinds. A pulse of sufficient duration to enable this unit to function reliably is provided by means of a flip-flop that is set by one pulse from the coin switch and a moment later is reset by a counter counting $\frac{1}{2}$ $H_3$ pulses from the pulse generator used in a number of timing situations.

GRINDING SEQUENCES

To grind, the grinding wheel carriage assembly 17 must be moved forward and backward relative to the stationary skate, the grinding wheel raised into engagement with the skate blade, and the grinding motor 61 turned on.

A series of limit switches, seven in all, are mounted in the machine so that, as the grinding wheel carriage 17 moves, it trips these switches in sequence; two such switches 407, 408, FIG. 3 are connected in parallel at each end of the traverse, to accommodate extra-large skates. These switches 407 and 408, FIG. 3 are activated by trippers 409 and 410, FIG. 9 respectively. These trippers 409 and 410 are mounted lower in height than trippers 402 to allow passage of trippers 409 and 410 under switches 43. Accordingly switches 407 and 408 are mounted lower than switches 43. The "fail limit" is included to accommodate the situation when a forward or reverse limit switch fails to function. The centre limit switch 406, is operated by three separate trippers 404, 405, and 404', FIG. 9 so that it gives two valid signals on each pass.

Because the sequence is repetitious a counter U16 is provided, which registers events during one cycle, and directs the sequence to repeat, first in one direction and then in the other. A second counter U17, registers the passes, and after two passes in each direction interrupts the sequence and calls for a dressing of the grindstone 56. When dressing has been accomplished, as heretofore described, the grinding sequence is allowed to continue and the door 11 opens, the skates are released, the door closes and the hydraulic pump 200 shuts down.

THE DRESSING CYCLE

The dressing sequence mentioned above is initiated when the grindstone 56 reaches the centre position A, FIG. 5, after the pass counter has been stepped to position "2" by the reverse limit switch. The "and" gate controlling the "set" of the Dresser Flip Flop U46 goes high at this point, and the grinding assembly has come to rest, with the stone resting squarely on the point of the diamond dresser 113. The logic and control elements will produce the following events:

(i) The vacuum motor 300 is turned on to collect the material dressed off the grindstone;

(ii) The grinding wheel assembly 16 is rigidly clamped hydraulically for dressing;

(iii) The grinder motor 61 is started and the dresser motor 122 is started, causing the diamond 113 to sweep backward and forward over the face of the stone in a circular path of ¾ inch radius. Each sweep is recorded on the pass counter U44 and when a preset number of passes is reached, the dresser motor 122 is stopped, so the diamond 113 always comes to rest under the stone in its "start" position.

(iv) The grinder motor 61 is shut off, and a timer U50 allows sufficient time for the grinding stone 56 to stop before moving counter U44 to position 7, which resets the dresser flip flop, allowing the grinding cycle to continue.

ENDING CYCLE

The grinding sequence is completed with one more full pass. The pass counter is stepped to position 8 which provides one input to the "and" gate U42. When the grindstone 56 reaches its mid position A, FIG. 5, and the center limit switch closes, the "and" goes high resetting the master Flip Flop and stopping all the grinding sequence, also calling for the door 11 to open through Flip Flop U24. Counter V7 determines the time the door remains open for the customer to remove the skates. When the door is called to open a "Pump on" flip flop U24 is set, in order to keep the hydraulic pump 200 operating, in order to complete the cycle. This latter flip flop is reset when the door 11 closes opening a limit switch, thus shutting down the hydraulic pump 200 and holding the door 11 closed.

The Power Supply provides regulated +24 VDC for the valves and relays and +12 VDC for the Logic Circuitry.

For added current capabilities in the +24 VDC circuit a series pass transistor is used.

The 25 VAC input is full wave rectified by Bridge VJ048. Filtering is provided by a 200 μf 40 V Electrolytic capacitor.

Option on the board provides space for an additional 2200 μf 40 V capacitor in event of larger valves being used.

Tantalum capacitors on the input to each regulator improves frequency rejection; the 0.1 μf discs on the output improves the transient response.

Power resistors on the input to each regulator provide current limiting and, in the case of the series pass element, a forward bias condition.

The series pass element is forward biased by the current flow of the 24 V regulator. The output of the regulator clamps the transistor collector to 24 V. Increased load causes increased current flow from the regulator which causes increased current flow through the 10Ω power resistor which increases the forward biased emitter-base junction of the pass transistor.

A 15Ω resistor ahead of the 12 V regulator provides a voltage crop from the 24 V supply to prevent unnecessary power dissipation.

A suppression diode for spikes from the valves is connected from the +24 VDC output to ground.

For the "Out of Order" light to be on, the Out of Order flip flop U26 must be set by a positive pulse from U25.

If for some reason, the dresser stops so that dresser switch remains closed, the output of U-9 will then be high. This output is then ANDED by (U28) with the zero output of the pass counter, supplying the necessary data to cause the out of order flip flop to be set, turning on the out of order light, and energizing the coin lock out.

When the change stone switch is tripped, this sets the change stone flip flop (U25). The Q output is then ANDED by U35-3 with the output of the 0.0 function U35-2. This output then sets the out of order flip flop U26 and holds the change stone light on as long as this condition exists. This action, can also be caused by the closing of either the Forward or Reverse End Limit Switches.

When the "Open Door" keyed switch is closed it supplies one half of and AND U-35-1 condition and the other is supplied by the 0.0 U35-2 AND output. This output then turns on the clamp valve and sets the pump flip flop U24, causing the door to open.

Once the open door key switch is opened the AND U35-1 function just mentioned is lost, the clamp valve opens and the door closes. When the door closes it also closes the door switch U-18 which in turn resets the pump flip flop U24.

For the Tape Switch to cause the door to reopen the door must be partly open and the pass counter U44 must be at zero; these two conditions then are ANDED U-36-1 and this gate output is ANDED U36-2 with the inverted output of the tape.

The output of this gate then sets the door flip flop U24; its Q output then goes high and sets the pump flip flop U24 turning on the pump 200. The Q also turns on the clamp valve causing the door 11 to reopen.

When the flip flop U24 is set its $\overline{Q}$, output is low, removing the reset from the door timer, after 10 seconds its #5 output goes high. This output then resets the door flip flop **U24*a* and its Q goes low removing the set from the pump flip flop U-24*b*. It also lets the clamp valve open which allows the door to close. In doing so the door switch is closed and this resets the pump flip flop U-24 shutting off the pump 200**.

When the door flip flop **U24*a*** is reset, its $\overline{Q}$ is high, which resets the door timer, returning it to zero.

The closing of the reset switch supplies one half of an AND U-35-4 condition; the other is supplied by the $\overline{Q}$ output of **U25*a* being high and this is a result of the carriage 17 being on centre. The output of this AND U36-3 is used as part of another AND U36-4 condition and the other half is supplied by the output of the 0.0 AND U35-2**.

The output of this AND gate then sets a JK flip flop **U27-*b*** and its Q output closes the pump relay, vacuum relay, reverse valve and spindle relay.

When the reverse limit switch is closed it supplies one input of an AND U36-4 condition and the other is supplied by the 0.0 AND U36-4 output. The output of this gate then resets **U27-*b*** causing the grinding wheel spindle to drop and also the reverse valve to open.

At the same time this pulse sets the other half of U27A and its Q output causes the pump to remain on and also the vacuum motor. When the carriage returns to centre, it closes the centre limit switch 406, which causes U27A to be reset, thereby turning off pump 200 and vacuum motors, causing the carriage to stop on centre position A, FIG. 5.

The Q output of U27A also resets the out of order flip flop U26A which turns off the out of order light. This $\overline{Q}$ output U27A also resets U25A and in doing so turns off the change stone light, if operating.

Operation of the logic in the foregoing embodiment of the invention will now be explained having regard to the cycling of the machine. As the machine sits in a reset mode, the master flip flop U13 comes up with the $\overline{Q}$ high, which resets the coin counter U4 assuring that the zero output will be high, this high output in turn resets spindle and grind counter U8, pass counter U44 as well as flip flop U30A, U29 and U46 for the Forward and Reverse Valve, Grind & Spindle, Dress valve and relay.

When the first coin passes thru the coin mechanism a pulse passes thru U14 to the set of the master flip flop U13 causing the Q and $\overline{Q}$ to change state. The reset of coin counter U4 is not felt immediately because of a RC network separating the two chips. This delay of approximately 200 m. sec. allows the condition of the AND gate U10 to be met. One input is tied to zero output of the coin counter U4 and the other input received a high pulse when the coin passes through the coin switch U18 going high sets U12 causing the coinage counter to count one. The Q of U12 (2) going high sets U13 causing the $\overline{Q}$ to go low; this removes the reset from U21 allowing the timer to begin timing. After approximately one half second U21 will reset U13 and U12; U13 at the same time also resets the reset timer U21, discontinuing timing. When the $\overline{Q}$ of the master flip flop goes low the reset is also removed from the master timers U7 and U6 and if the start button is not depressed within a preset time interval, the logic will cycle and shut down.

By the time the second coin is placed in the coin mechanism the reset will have been removed from the coin counter U4 allowing it to advance one count thus removing the resets from Spindle and Grind counter, pass counter and flip flops U30A and U30B. The 3rd coin will cause the coin counter to advance one more as with the fourth coin.

The fourth coin which causes the 3rd output of U4 to go high, which turns on the pump 200 and clamp valve to turn on via buffers U37A, U37B and or Gates U16 and U33 which opens the door 11 and prepares the clamping assembly 14 for skates.

The 3rd output of U15 satisfies one half of AND Gate U36; placing the skates in position and closing toe clamps will open heel switches and remove ground, thereby satisfying the other half of AND Gate U36, allowing start light to come on, and also energizing the start button U19.

Pushing the start button satisfies the other half of AND Gate U10 and causes the number of grinds counter to count in similar fashion to the coin counter.

The start button also causes the coin counter to advance to the fourth output, this removes the clamp valve allowing the door to close but holds the pump on, via U16, U25 and U37. Also the start button sets the Forward Valve Flip Flop U30A allowing Q to go high and satisfy one half of the AND Gate U23.

The start button also resets the Master Timers U7 and U6.

The centre limit switch sits on a cam allowing one input of U14 to be high; thus the output is high, however this does not cause the Spindle and Grind Counter to count as there is no change in level. When the start button is depressed a second high input causes the output of U14 to go low, still not clocking the Spindle and Grind counter when the start button is released one input goes low on U14 and the output goes high clocking the Spindle and Grind counter U8 to one providing one half of And Gate U22.

Once the door closes the And Gate, conditions of U22 and U23 are satisfied setting the spindle flip flop U29 and one half of And Gate 23 in both spindle and forward valve circuitry. These two And Gates are anded with the $\overline{Q}$ of the dress valve to ensure that no spindle or forward valve may occuring during a dress, if this is satisfied the forward valve and spindle are activated.

The forward movement of the carriage off the first cam causes the input of U14 to go low when the centre cam is reached the input to U14 goes high as does the output which causes the spindle and grind counter U8 to advance to the second output; this sets the grind flip flop U29(1) allowing the grind stone 56 to start.

The grinder will continue to grind until the forward limit switch is reached, this resets the spindle and Grind Counter U8, V1A U17, U17 and U15. U8 returing to zero output resets U29A and U29B dropping out the spindle and grind.

Simultaneously the Forward Valve Flip Flop U30A is reset, dropping it out immediately and the Reverse valve flip flop U30B is set; the carriage does not being in the reverse direction immediately because of the RC configuration involving U26 at the output of U23, allowing approximately 470 milliseconds before the Reverse valve will come on.

When the carriage returns to centre in the Reverse direction the centre limit switch hitting the first cam will advance the Spindle and Grind Counter one setting U8 causing the spindle to rise, the second cam causes the Spindle and Grind Counter to advance to the second output, starting the grinder; this has no effect on the "Spindle up" and "Grind", however since they are JK Flip Flop and have already been set.

The machine will continue to grind in the reverse direction until the Reverse limit switch is reached; this will reset U8 causing the zero outset to go high, thus resetting U29A and U29B, dropping out the spindle and grind.

At the same time the Reverse valve flip flop U30B is reset immediately dropping out the Reverse valve and setting the Forward valve flip flop U30A. Like the Reverse valve, there is a 470 millisecond delay before the Forward valve is activated because of an RC network across U26 at the Q output of flip flop U30; this length of delay is used so that there will be no delay causing overshooting of trippers.

The Reverse limit switch also causes the Pass Counter U44 to advance to the first output.

The sequence just explained involving the movement of the carriage between the Reverse and Forward limit switches continues, until the Reverse limit switch has been tripped twice.

When the reverse limit switch is reached for the second time the Pass Counter U44 is advanced to the second output; this provides one half of And Gates U39, the carriage will now return to centre as before, reaching the first cam switching the centre tripper causing the Spindle and Grind Counter U8 to advance one to the first output. At this time the Forward valve will discontinue and spindle will fail to come up, because the carriage returning to centre provides the output half of U39 And Gate which sets the dress valve and dress relay Flip Flop U46A and U46B. The $\overline{Q}$ of U46A low disables the Forward valve and spindle as And Gates U23 no longer have the necessary high from the $\overline{Q}$ of U46A to complete and conditions and give outputs.

Once the carriage returns to centre the dress valve Flip Flop U46 is set by And Gate U39. Due to the RC network of U42 the spindle has approximately 1.3 sec. to settle before being clamped to secure the spindle during dress. The dress relay U46B is set at the same time as the dress valve and immediately turns on the vacuum via U42 and U49.

U42 goes high with the Q of U46B but before the dress relay can be activated starting the Grind motor sufficient pressure must be obtained to hold the spindle, once the necessary pressure is achieved both inputs to U42 will be high and the dress relay will be energized thereby starting grind motor and dress motor.

Dress Switch U18 output is normally low on cam. This output is fed to U45A (SET) U-39-3 and inverter U43-5.

On the flat of the cam U45A is held reset through inverter U43. One half of U39-1 and gate is high. When the motor rotates off the flat, U45A is set. The Q goes low U47 Pulse Gen. Counts. After 3 seconds output goes high which sets U45B. Q output high to U39-1, when cam returns to flat, U39-1 pin 3 goes high. The and condition of U46B Q, pressure switch via U42-4 ands U39-2. This output pulses U40-2, U40-1, U43(1-2) and clocks pass counter U44, resets U45B.

This process repeats unitl U44 6 output goes high-U46B is reset. The motor stops. 6 output via inverter U43-4 removes reset from U50. After 10 seconds output 5 goes high and clocks U44 via U40 and U43. U46A is reset, the $\overline{Q}$ goes high enabling U29B and U23-2 to operate, causing the spindle to rise and permitting the forward valve to function.

This cycle continues as heretofore explained, until the reverse limit switch is tripped for the 3rd time, advancing the pass counter to the eighth output which supplies one half of the End of Cycle And Gate U42 when the carriage returns to centre clocking the Spindle and Grind Counter to one which provides the other high for U42 its high output resets the Master Flip Flop via U49 and U14 and resets the logic to its original state.

The high output from the End of Cycle Gate sets U24A (Door Flip Flop) which turns on the clamp valve and sets U24B which turns on the pump. U24 being reset causes $\overline{Q}$ to go low removing the reset from door timer U20 and it begins to time; when the fifth output (10) goes high U24A is reset and in so doing resets U20 and allows the door to close. When the door is closed U24B is reset which turns off the pump motor.

ANALOG CIRCUIT

The purpose of the analog circuit is to monitor the power drawn by the grinding motor during the grinding process and to control the amount of power to the hysteresis clutch, which applies the grinding pressure by way of the spindle position. This maintains a constant grinding speed throughout the grind for different skates and stone sizes.

The power drawn by the grinding motor is computed by measuring the current and voltage, then multiplying to obtain power. (P=IE). In the foregoing embodiment of this invention, the measuring device is a 0.1Ω25 W resistor in series with the grinding motor. The voltage drop across this resistor is directly proportional to the current flow through it. Since the current through the resistor is approximately 6 amperes, the voltage drop across the resistor will be approximately 0.6 volts.

This voltage is amplified by an operational amplifier (IC-I) with a gain of ten, and fed to the Y input of the 432 OR 532 analog multiplier (IC-3).

This voltage is amplified by an operational amplifier (IC-I) with a gain of ten, and fed to the Y input of the 432 OR 532 analog multiplier (IC-3).

Line Voltage (120 VAC) is divided down to approximately 6 volts and fed into the X input of the multiplier (IC-3). The output of the multiplier, XY/10, is filtered and amplified with respect to the idling power of the grinding motor, which is the zero setting (R1). Thus, the power due to the grinding action only will be amplified by 1C1-2 with a gain of approximately 14. This signal is fed into inverting amplified LC2-1 with a gain of 75. 1C1-2 functions as a reverse-acting controller, comparing the input to the set point potentiomenter R2. 1C2-1 is also set up to perform proportional and integral log compensation. The output from 1C2-1 goes through a non-inverting summing amplifier (1C2-2) with unity gain. This output is fed to the inverting input of 1C-4, which has unity gain; its output feeds a driver (2N3053), emitter follower which in turn feeds a Darlington power transistor (R1P120) which in turn feeds a Darlington power transistor (T1P120) which controls power to the hysteresis clutch.

When the spindle relay (SR) and the grinding relay (GR) are not energized the output of the summing amplifier 1C2-2 is pulled down close to −15 volts. A small amount of power is fed to the hysteresis clutch. Adjustment of the Minimum Output potentiometer will allow setting of the hysteresis clutch to 35 milliamperes. When the SR contacts close, the spindle potentiometer is connected to +15 volts and the setting of this potentiometer is added to the summing amplifier (1C2-2). This setting should be high enough to raise the spindle into the pocket between the two heels of the skates, point "S", FIG. 5. The GR contacts close in the grind mode to complete the output circuit of 1C2-1. The output of 1C2-1 adds and subtracts from the spindle potentiometer setting. To prevent the spindle from dropping away from the skates when the grinder starts and to allow the spindle to follow the curve of the skate heel a clamp is used. The clamp is composed of two 1N914 diodes. When the grinder starts with "Spindle UP", the signal is allowed to drop approximately 22 milliamperes from the spindle setting and follow the blade curve. The clutch current monitored from the jacks will start at the "Spindle Up" setting, drop when the grinder starts and gradually increase throughout the grind.

With a digital voltmeter connected into the clutch circuit and a machine test box connected to the test outlet all analog adjustments can be made.

The Power Supply provides regulated +24 VDC for the valves and relays and +12 VDC for the Logic Circuitry.

For added current capabilities in the +24 VDC circuit a series pass transistor is used.

The 25 VAC input is full wave rectified by Bridge VJ048. Filtering is provided by a 2200 μf 40 V Electrolytic capacitor.

Option on the board provides space for an additional 2200 μf 40 V capacitor in event of larger valves being used.

Tantalum capacitors on the input to each regulator improves frequency rejection, the 0.1 μf discs on the output improves the transient response.

Power resistors on the input to each provide current limiting and, in the case of the series pass element, a forward bias condition.

The series pass element is forward biased by the current flow of the 24 V regulator. The output of the regulator clamps the transistor collector to 24 V. Increased load causes increased current flow through the 18Ω power resistor which increases the forward biased emitter-base junction of the pass transistor.

A 15Ω resistor ahead of the 12 V regulator provides a voltage drop from the 24 V supply to prevent unnecessary power dissipation.

A suppression diode for spikes from the valves is connected from the +24 VDC output to ground.

Obviously, many modifications and variations of the present invention are possible in light of the above teachings. It is to be understood therefore, that within the scope of the appended claims the present invention may be practices otherwise than as specifically described herein.

What is claimed is:

1. Grinding apparatus comprising in combination clamping means for securing a workpiece; a grinding wheel and means for mounting said grinding wheel to said clamping means for relative movement of said grinding wheel with respect to said workpiece;

sensing means for detecting the grinding resistance of said grinding wheel;

means for producing a biasing force for biasing said grinding wheel such that engagement of said grinding wheel with a surface of the workpiece may be controlled; and coupling means, independent of said biasing force producing means and having a variable coupling coefficient and responsive to said sensing means, connected between said biasing force producing means and said grinding wheel so as to mechanically couple said biasing force producing means to said grinding wheel for controlling the biasing applied to said grinding wheel.

2. Apparatus according to claim 1 further comprising electric motor driving means for energizing said grinding wheel and wherein said sensing means comprises means for measuring torque on said electric motor driving said grinding wheel.

3. The apparatus according to claim 2 in which said sensing means comprises means responsive to the power input to said electric motor.

4. Skate sharpening apparatus according to claim 1 additionally comprising grinding wheel dressing means adapted to maintain the cross-sectional profile of said grinding wheel.

5. Skate sharpening apparatus for ice skates comprising in combination:

clamping means for securing at least one skate blade;

a thin flat grinding wheel pivotally mounted within a grinding wheel carriage assembly to engage said skate blade along its bottom edge, co-planar with the principal longitudinal plane of said skate blade and with its axis of rotation normal thereto and having its transverse cross-sectional profile shaped to the desired cross-sectional profile of the skate blade bottom edge;

sensing means for detecting the grinding resistance of said grinding wheel;

means for mounting said clamping means to said carriage assembly for relative longitudinal movement of said grinding wheel with respect to said skate blade;

driving means for displacement of said grinding wheel relative to said skate blade;

means for producing a biasing force for biasing said grinding wheel such that engagement of said grinding wheel with the skate blade may be controlled; and coupling means, independent of said biasing force producing means and having a variable coupling coefficient and responsive to said sensing means, connected between said biasing force producing means and said grinding wheel so as to mechanically couple said biasing force producing means to said grinding wheel for controlling the biasing applied to said grinding wheel.

6. Skate sharpening apparatus according to claim 5 and in which said driving means and said biasing force producing means are adapted to move said grinding wheel along the non-rectilinear bottom edge of said skate blade.

7. Skate sharpening apparatus according to claim 6 in which both members of a pair of skates may be clamped simultaneously with the blades in alignment.

8. Skate sharpening apparatus according to claim 7 in which the two skate blades are arranged in heel-to-heel relationship including limit switch means adapted to arrest traversing of the grinding wheel carriage assembly at an appropriate predetermined location adjacent to the toe of each member of the pair of skates.

9. Skate sharpening apparatus according to claim 5 additionally comprising grinding wheel dressing means adapted to maintain the cross-sectional profile of said grinding wheel.

10. Skate sharpening apparatus for ice skates comprising in combination:

clamping means for securing both members of a pair of skates with the blades in co-planar alignment;

a grinding wheel carriage assembly mounted to said clamping means for relative reciprocal movement with respect to said blades, including traversing means for such movement;

a thin, flat grinding wheel mounted on said grinding wheel carriage assembly co-planar with the principal longitudinal plane of said pair of skates having a horizontal axis of rotation disposed normal to said longitudinal plane of said pair of skates and adapted to subsequently engage each member of said pair of skate blades along the bottom edge thereof and having its transverse cross-sectional profile shaped to the desired cross-sectional profile of the skate blade bottom edge;

sensing means for detecting the grinding resistance of said grinding wheel;

driving means for energizing said grinding wheel;

means for producing a biasing force for biasing said grinding wheel such that engagement of said grinding wheel with the skate blade bottom edges may be controlled; and coupling means, independent of said biasing force producing means and having a variable coupling coefficient and responsive to said sensing means, connected between said biasing force producing means and said grinding wheel so as to mechanically couple said biasing force producing means to said grinding wheel for controlling the biasing applied to said grinding wheel.

11. Skate sharpening apparatus according to claim 10 wherein said driving means for energizing said grinding wheel is an electric motor and wherein said sensing means comprises means responsive to the power input to said electric motor.

12. Skate sharpening apparatus according to claim 11 additionally comprising grinding wheel dressing means adapted to maintain the cross-sectional profile of said grinding wheel.

13. The grinding apparatus of claims 1, 5, or 10 wherein said biasing means comprises motor means producing a constant biasing torque and said coupling means comprises variable clutch means.

14. The grinding apparatus of claim 13 wherein said clutch means comprises a hysteresis clutch.

15. The grinding apparatus of claims 1, 5, or 10 wherein said biasing means comprises first means for biasing said grinding wheel out of engagement with the workpiece and second means for biasing said grinding wheel into engagement with the workpiece; and wherein said couping means is coupled to at least one of said first and second biasing means.

16. The grinding apparatus of claim 15 further comprising support means defining first and second arms joined together at an angle pivotably mounted to said mounting means, said grinding wheel being rotatably mounted on said first arm at the distal end thereof such that said grinding wheel may be displaced into and out of engagement with the workpiece by pivoting said support means, and said first biasing means is connected to a first one of said first and second arms and said second biasing means is connected to a second one of said first and second arms and said coupling means is coupled to at least one of said first and second biasing means and to at least one of said first and second arms.

* * * * *